US011338535B2

(12) United States Patent
Akita et al.

(10) Patent No.: US 11,338,535 B2
(45) Date of Patent: May 24, 2022

(54) SHEET FOLDING DEVICE AND METHOD, AND BOX-MAKING MACHINE

(71) Applicant: MITSUBISHI HEAVY INDUSTRIES MACHINERY SYSTEMS, LTD., Hyogo (JP)

(72) Inventors: Kazuya Akita, Hyogo (JP); Makoto Shimohatsubo, Hyogo (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 154 days.

(21) Appl. No.: 16/302,775

(22) PCT Filed: Oct. 12, 2017

(86) PCT No.: PCT/JP2017/037055
§ 371 (c)(1),
(2) Date: Nov. 19, 2018

(87) PCT Pub. No.: WO2018/088108
PCT Pub. Date: May 17, 2018

(65) Prior Publication Data

US 2019/0291377 A1 Sep. 26, 2019

(30) Foreign Application Priority Data

Nov. 8, 2016 (JP) ..... JP2016-218179

(51) Int. Cl.
*B31B 50/58* (2017.01)
*B31B 50/25* (2017.01)
(Continued)

(52) U.S. Cl.
CPC ..... *B31B 50/58* (2017.08); *B31B 50/04* (2017.08); *B31B 50/20* (2017.08); *B31B 50/25* (2017.08);
(Continued)

(58) Field of Classification Search
CPC ..... B31B 50/04; B31B 50/042; B31B 50/20; B31B 50/25; B31B 50/58; B31B 50/88;
(Continued)

(56) References Cited

U.S. PATENT DOCUMENTS 3,797,371 A * 3/1974 Randle ..... B31B 50/00 493/295
3,850,085 A * 11/1974 Klemm ..... B31B 50/00 493/131
(Continued)

FOREIGN PATENT DOCUMENTS

CN 104093556 A 10/2014
DE 2911969 A1 10/1980
(Continued)

OTHER PUBLICATIONS

Written Opinion of the International Searching Authority for International Application No. PCT/JP2017/037055 dated Nov. 21, 2017; 9pp.
(Continued)

*Primary Examiner* — Robert F Long
*Assistant Examiner* — Eduardo R Ferrero
(74) *Attorney, Agent, or Firm* — Hauptman Ham, LLP

(57) ABSTRACT

A sheet folding device and method, and a box-making machine, wherein are provided a molding belt for moving on a center side in the width direction of a cardboard sheet toward a downstream side in a transfer direction of the cardboard sheet and thereby pressing and folding both end parts in the width direction of the cardboard sheet from the outside, and a folding roller group formed by folding rollers for contacting insides of fold parts on both sides in the width direction of the cardboard sheet more toward the center in the width direction of the cardboard sheet than the molding belt, the folding rollers being arranged further upstream in
(Continued)

the transfer direction of the cardboard sheet than a 90-degree folding position of the cardboard sheet.

11 Claims, 9 Drawing Sheets

(51) Int. Cl.
*B31B 50/20* (2017.01)
*B31B 50/04* (2017.01)
*B31B 50/88* (2017.01)
*B31B 100/00* (2017.01)

(52) U.S. Cl.
CPC ..... *B31B 50/88* (2017.08); *B31B 2100/0022* (2017.08)

(58) Field of Classification Search
CPC ..... B31B 2100/0022; B31B 50/26; B31F 1/0012; B31F 1/0022; B31F 1/0025; B31F 1/08
USPC ..... 493/442
See application file for complete search history.

(56) References Cited

U.S. PATENT DOCUMENTS 4,041,849 A * 8/1977 Tsukasaki ..... B31B 50/00 493/436
4,132,157 A 1/1979 Shinomiya
4,315,752 A 2/1982 Moen
4,410,390 A * 10/1983 Farrell ..... B29C 53/043 156/200
4,834,696 A * 5/1989 Marschke ..... B65H 45/12 493/179
5,997,459 A * 12/1999 Kruger ..... B31F 1/0022 493/161
6,231,493 B1 * 5/2001 Kato ..... B31F 1/08 493/178
6,478,725 B1 * 11/2002 Bengt ..... B26D 1/245 493/59
7,708,679 B2 * 5/2010 Cailloux ..... B31B 50/00 493/401
2009/0062098 A1 * 3/2009 Inoue ..... B26D 7/2642 493/442
2009/0203509 A1 * 8/2009 Wiklund ..... B31F 1/10 493/179
2010/0288142 A1 * 11/2010 Sugimoto ..... B41F 31/301 101/216
2011/0092351 A1 * 4/2011 Hatano ..... B31B 50/00 493/162
2013/0184135 A1 7/2013 Duer
2015/0024917 A1 1/2015 Nadachi et al.
2015/0068664 A1 * 3/2015 Stober ..... B31F 1/10 156/73.1
2017/0057191 A1 3/2017 Herfurth
2017/0274612 A1 * 9/2017 Nadachi ..... B05C 11/1005
2017/0355166 A1 * 12/2017 Jonker ..... B31F 1/10
2018/0001587 A1 1/2018 Yamamuro et al.
2018/0015682 A1 * 1/2018 Iori ..... B65H 29/52

FOREIGN PATENT DOCUMENTS

DE 102014107031 A1 11/2015
EP 1398141 A2 3/2004
EP 2818312 A1 12/2014
GB 2270304 A 3/1994
JP S50144572 A 11/1975
JP S51115176 A 10/1976
JP S547930 A 1/1979
JP S5537423 B2 9/1980
JP S57136731 U 8/1982
JP H0687176 A 3/1994
JP 2005088456 A 4/2005
JP 2006150748 A 6/2006
JP 4609809 B2 1/2011
JP 2016129987 A 7/2016
WO 2007096778 A2 8/2007

OTHER PUBLICATIONS

Extended European Search Report for European Application No. 17868655.6 dated Jul. 4, 2019; 9pp.
Office Action for Chinese Application No. 201780031468.9 dated Oct. 23, 2019; 16 pp.
Office Action for Korean Application No. 10-2018-7034504 dated Mar. 11, 2020; 9pp.

* cited by examiner

SHEET FOLDING DEVICE AND METHOD, AND BOX-MAKING MACHINE

RELATED APPLICATIONS

The present application is a National Phase of International Application Number PCT/JP2017/037055 filed Oct. 12, 2017 and claims priority to Japanese Application Number 2016-218179 filed Nov. 8, 2016.

TECHNICAL FIELD

The present invention relates to a sheet folding device and a sheet folding method which form a flat corrugated box by folding a corrugated fiberboard while transferring the corrugated fiberboard in a process of manufacturing a corrugated box and a box making machine including the sheet folding device.

BACKGROUND ART

A general box making machine manufactures a box body (corrugated box) by processing a sheet material (for example, a corrugated fiberboard), and includes a sheet feeding section, a printing section, a slotter creaser section, a die cutting section, a folding section (folder gluer), and a counter-ejector section. In the sheet feeding section, the corrugated fiberboards stacked on a table are fed to the printing section one by one at a constant speed. The printing section includes a printing unit and performs printing on the corrugated fiberboard. In the slotter creaser section, creasing lines which become folding lines are formed on the printed corrugated fiberboard, and processing of grooves becoming flaps or gluing margin strips for joining is performed. In the die cutting section, punching such as hand hole is performed on the corrugated fiberboard on which the creasing lines, the grooves, and gluing margin strips are formed. In the folding section, glue is applied to the gluing margin strip and the corrugated fiberboard on which the creasing lines, the grooves, the gluing margin strips, and the hand holes are formed is folded along the creasing lines while the corrugated fiberboard moves, and the gluing margin strips are joined to each other to manufacture a flat corrugated box. In addition, in the counter-ejector section, the corrugated boxes in which corrugated fiberboards are folded and glued are stacked, the stacked corrugated boxes are sorted by a predetermined number of batches, and the sorted corrugated boxes are discharged.

In the above-described slotter creaser section, a first creasing line roll crushes the corrugated fiberboard at a predetermined position, and a second creasing line roll forms folding lines (creasing lines) at a position which becomes a reference of the folding, and in the folding section, the corrugated fiberboard is folded at the positions of the folding lines. In the folding section, folding rails and guide plates are disposed in series along a transfer direction on both sides of the corrugated fiberboard in the transfer direction, several gauge rollers are disposed outside the folding rails and guide plates along the transfer direction, and a folding belt and a folding bar are disposed. Accordingly, the corrugated fiberboard is transferred while a position in a width direction is restricted by the folding rails and is pressed by the folding belt and the folding bar, and thus, both end portions in the width direction are bent downward. In addition, when both end portions in the width direction of the corrugated fiberboard are bent downward, bending portion sides of both ends in the width direction of the corrugated fiberboard are held by the several gauge rollers, both bent end portions are closely adhered to the inside, and a flat corrugated box is formed. The sheet folding device of the related art is disclosed in PTL 1 below.

Meanwhile, the corrugated fiberboard has different rigidities according to a thickness, a nature, a shape, or the like of a liner or a core paper. If the corrugated fiberboard has a high rigidity, it is necessary to form the folding lines while the corrugated fiberboard is firmly crushed at a predetermined position of the corrugated fiberboard by the respective creasing line rolls. Meanwhile, if the corrugated fiberboard has a low rigidity, if the folding lines are formed while the corrugated fiberboard is crushed at the predetermined position of the corrugated fiberboard by the respective creasing line rolls similarly to the corrugated fiberboard having a high rigidity, in the folding section, the folding position of the corrugated fiberboard may be offset in the width direction or the corrugated fiberboard may be damaged.

Accordingly, for example, in a folder gluer described in PTL 2, a crushing roller is provided on a downstream side of a folding rail, a corrugated fiberboard is bent up to 90° along the folding rail, and thereafter, side portions of the corrugated fiberboard bent up to 90° by the crushing roller are crushed so as to be bent 90°.

CITATION LIST

Patent Literature

[PTL 1] Japanese Patent No. 4609809

[PTL 2] Japanese Unexamined Patent Application Publication No. 2005-088456

SUMMARY OF INVENTION

Technical Problem

In the above-described PTL 2, the crush roller crushes the side portions of the corrugated fiberboard whose end portion is bent 90° at the predetermined position. In the folding section, the end portion of the corrugated fiberboard is pressed and bent by a folding belt and a folding bar, a downstream side in a transfer direction of the corrugated fiberboard is bent ahead of an upstream side. Accordingly, the corrugated fiberboard is dragged toward the downstream portion where the bending is performed in advance at a predetermined position at which the crushing roller, and thus, the corrugated fiberboard is pressed to the crushing roller side. Accordingly, the corrugated fiberboard embraces the crushing roller disposed inside the bending portion, and thus, it is difficult to accurately perform the bending.

The present invention is to solve the above-described problems, and an object thereof is to provide a sheet folding device, a sheet folding method, and a box making machine capable of improving bending accuracy of the corrugated fiberboard.

Solution to Problem

In order to achieve the above-described object, according to an aspect of the present invention, there is provided a sheet folding device including: forming belts which are disposed on both sides in a transfer direction of a corrugated fiberboard and move to a center side in a width direction of the corrugated fiberboard toward a downstream side in the transfer direction of the corrugated fiberboard so as to press and bend both end portions of the corrugated fiberboard in the width direction from outside; and forming rollers which are disposed on the center side in the width direction of the corrugated fiberboard from the forming belts on both sides in the transfer direction of the corrugated fiberboard and come into contact with inner sides of both bending portions of the corrugated fiberboard in the width direction, I which the forming rollers are disposed on an upstream side in the transfer direction of the corrugated fiberboard from a 90° bending position of the corrugated fiberboard.

Accordingly, the forming belts move to the center side in the width direction toward the downstream side in the transfer direction of the corrugated fiberboard in a state where the forming rollers support inner sides of both bending portions of the corrugated fiberboard in the width direction, and thus, both end portions of the corrugated fiberboard in the width direction are pressed and bent from the outside. In this case, the forming rollers support the bending portions of the corrugated fiberboard on the upstream side in the transfer direction of the corrugated fiberboard from the 90° bending position of the corrugated fiberboard, and thus, the forming rollers are not embraced inside the corrugated fiberboard bent 90° or more, and offset of a bending position of the corrugated fiberboard can be suppressed. As a result, the corrugated fiberboard can be bent at an appropriate position, and it is possible to improve bending accuracy of the corrugated fiberboard.

In the sheet folding device of the present invention, the forming roller is disposed on the upstream side in the transfer direction of the corrugated fiberboard from a position outside a bending position of the forming belt in the width direction of the corrugated fiberboard.

Accordingly, the forming belts move to the center side in the width direction toward the downstream side in the transfer direction of the corrugated fiberboard in a state where the forming rollers support the inner sides of both bending portions of the corrugated fiberboard in the width direction, and thus, both end portions of the corrugated fiberboard are pressed and bent from the outside on a region outside the bending position of the corrugated fiberboard, the forming rollers are not embraced inside the corrugated fiberboard bent 90° or more, and the offset of the bending position of the corrugated fiberboard can be suppressed.

In the sheet folding device of the present invention, upstream-side folding rails are disposed on both sides in the transfer direction of the corrugated fiberboard along the transfer direction of the corrugated fiberboard on the upstream side in the transfer direction of the corrugated fiberboard from the forming rollers.

Accordingly, after the corrugated fiberboard is supported by the upstream-side folding rails, the corrugated fiberboard is supported by the forming rollers, both end portions thereof are pressed and bent by the forming belts, and thus, it is possible to improve the bending accuracy of the corrugated fiberboard.

In the sheet folding device of the present invention, downstream-side folding rails are disposed on both sides in the transfer direction of the corrugated fiberboard along the transfer direction of the corrugated fiberboard on the downstream side in the transfer direction of the corrugated fiberboard from the forming rollers.

Accordingly, the corrugated fiberboard is supported by the forming rollers, both end portions thereof are pressed and bent up to before 90° by the forming belts, and thereafter, the corrugated fiberboard is supported by the downstream-side folding rails, and thus, it is possible to improve the bending accuracy of the corrugated fiberboard.

In the sheet folding device of the present invention, the forming roller has a protrusion shape in which an intermediate portion in the width direction protrudes outward in a radial direction, and a impression roller which faces the forming roller in the radial direction and has an outer peripheral surface which is flat in the radial direction is disposed is disposed.

Accordingly, when both end portions of the corrugated fiberboard are pressed and bent from the outside by the forming belts, the inner side of the corrugated fiberboard is supported by the forming rollers each having the protrusion shape, the outer side of the corrugated fiberboard is supported by the flat impression rollers, and thus, damages of the corrugated fiberboard can be suppressed and the corrugated fiberboard can be bent at an appropriate bending position.

In the sheet folding device of the present invention, several forming rollers and several impression rollers are disposed along the transfer direction of the corrugated fiberboard and are disposed to be gradually inclined toward the downstream side in the transfer direction of the corrugated fiberboard.

Accordingly, the several forming rollers and the several impression rollers are disposed to be gradually inclined toward the downstream side in the transfer direction of the corrugated fiberboard, and thus, the corrugated fiberboard can be appropriately bent up to a predetermined angle gradually.

In the sheet folding device of the present invention, the forming roller includes a protrusion portion formed by an intermediate portion in the width direction protruding outward in a radial direction, an inner peripheral surface which is provided on a center side in the width direction of the corrugated fiberboard from the protrusion portion, and an outer peripheral surface which is provided on an end portion side in the width direction of the corrugated fiberboard from the protrusion portion, and an angle of the inner peripheral surface with respect to an axial direction is larger than an angle of the outer peripheral surface with respect to the axial direction.

Accordingly, the angle of the inner peripheral surface is larger than the angle of the outer peripheral surface, and thus, when the end portion of the corrugated fiberboard is bent, an excessive contact between the sheet piece whose horizontal state is maintained and the inner inclined surface is prevented, and it is possible to prevent deformation or damages of the corrugated fiberboard.

In the sheet folding device of the present invention, the forming rollers include a forming roller for a single-layer corrugated fiberboard in which a waveform portion is a single layer and a forming roller for a multi-layer corrugated fiberboard in which a waveform portion is a multi layer, and a movement unit which moves the forming roller for the single-layer corrugated fiberboard and the forming roller for the multi-layer corrugated fiberboard to a processing position and a retreat position is provided.

Therefore, according to a type of the corrugated fiberboard, the forming roller for the single-layer corrugated fiberboard and the forming roller for the multi-layer corrugated fiberboard are selectively moved to the processing position by the movement unit and are used, and thus, the corrugated fiberboard is bent by the forming roller corresponding to the type of the corrugated fiberboard, the damages of the corrugated fiberboard are suppressed, and the corrugated fiberboard can be bent at an appropriate bending position.

In addition, according to another aspect of the present invention, there is provided a sheet folding method including: a step of bending both end portions in a width direction of the corrugated fiberboard up to before 90° by a forming belt in a state where a bending position of a transferred corrugated fiberboard is supported by a forming roller; and a step of bending both end portions in the width direction of the corrugated fiberboard up to 180° by the forming belt in a state where the bending position of the transferred corrugated fiberboard is supported by a guide plate.

Accordingly, the forming rollers are not embraced inside the corrugated fiberboard bent 90° or more, and the offset of the bending position of the corrugated fiberboard can be suppressed. As a result, the corrugated fiberboard can be bent at an appropriate position, and it is possible to improve bending accuracy of the corrugated fiberboard.

In addition, according to still another aspect of the present invention, there is provided a box making machine including: a sheet feeding section which supplies a corrugated fiberboard; a printing section which performs printing on the corrugated fiberboard; a slotter creaser section which performs creasing line processing and slicing on the printed corrugated fiberboard; a folding section which includes the sheet folding device; and a counter-ejector section which stacks flat corrugated boxes while counting the flat corrugated boxes and thereafter, discharges the flat corrugated boxes every predetermined number.

Accordingly, the printing is performed on the corrugated fiberboard from the sheet feeding section in the printing section, the creasing line processing and the slicing are performed in the slotter creaser section, the corrugated fiberboard is folded in the folding section such that end portions thereof are joined to each other so as to form a box body, and the box bodies are stacked while being counted in the counter-ejector section. In this case, in the sheet folding device, the forming rollers support the bending portions of the corrugated fiberboard on the upstream side in the transfer direction of the corrugated fiberboard from the 90° bending position of the corrugated fiberboard, and thus, the forming rollers are not embraced inside the corrugated fiberboard bent 90° or more, and offset of a bending position of the corrugated fiberboard can be suppressed. As a result, the corrugated fiberboard can be bent at an appropriate position, and it is possible to improve bending accuracy of the corrugated fiberboard.

Advantageous Effects of Invention

According to the sheet folding device, the sheet folding method, and the box making machine, the forming belts and the forming rollers are provided and the forming rollers are disposed on the upstream side from the 90° bending position of the corrugated fiberboard. Therefore, the forming rollers are not embraced inside the corrugated fiberboard bent 90° or more, the corrugated fiberboard can be bent at an appropriate position, and it is possible to improve bending accuracy of the corrugated fiberboard.

DESCRIPTION OF EMBODIMENTS

Hereinafter, preferred embodiments of a sheet folding device, a sheet folding method, and a box making machine according to the present invention will be described in detail with reference to the accompanying drawings. In addition, the present invention is not limited by the embodiment, and in a case where several embodiments are provided, the present invention includes those which are obtained by combining the embodiments.

Figure 1:
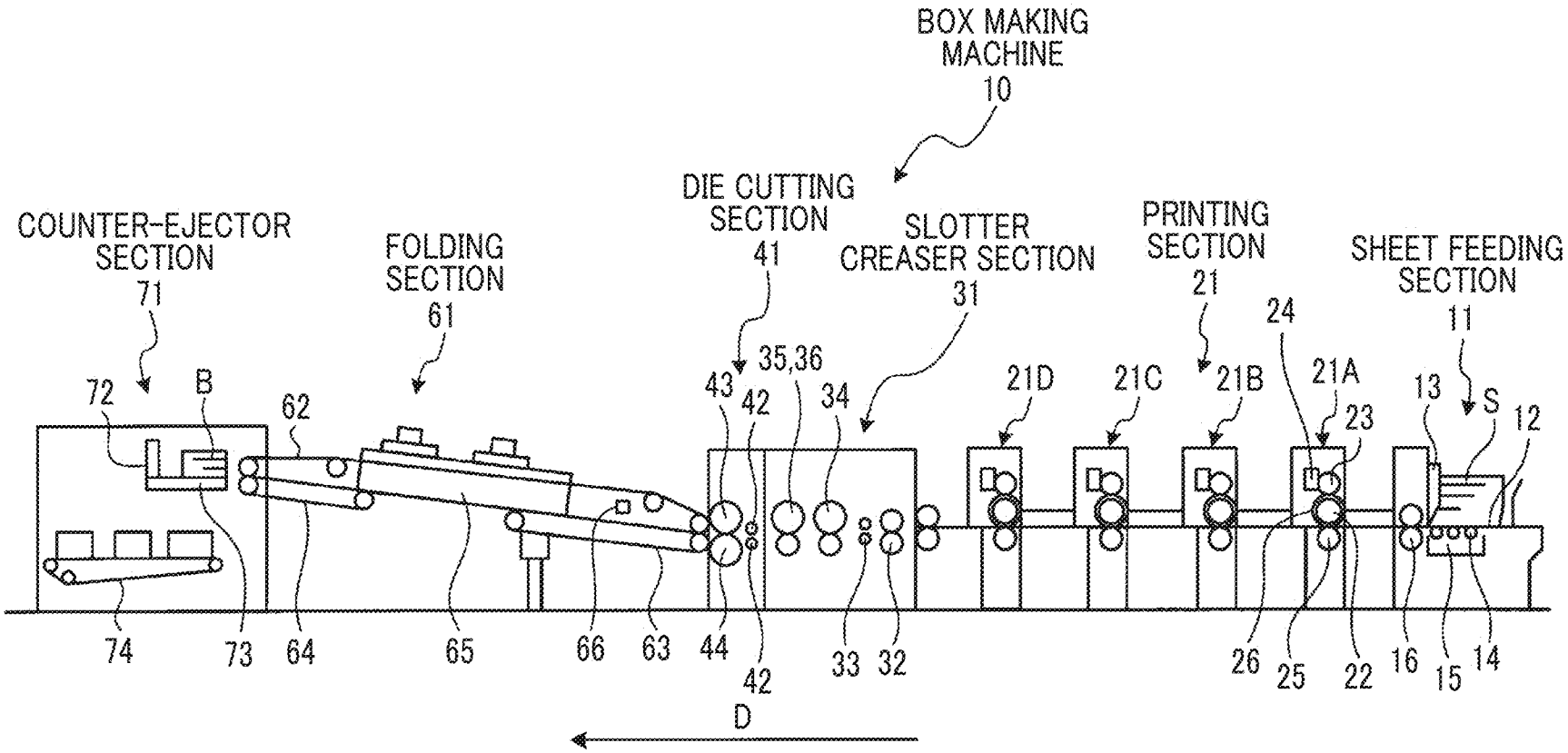
FIG. 1 is a schematic configuration view showing a box making machine of the present embodiment.

FIG. 1 is a schematic configuration view showing a box making machine of the present embodiment.

In the present embodiment, as shown in FIG. 1, a box making machine 10 manufactures a corrugated box (box body) B by processing a corrugated fiberboard S. The box making machine 10 includes a sheet feeding section 11, a printing section 21, a slotter creaser section 31, a die cutting section 41, a folding section 61, a counter-ejector section 71 which are linearly disposed in a transfer direction D in which the corrugated fiberboard S and the corrugated box B are transferred.

In the sheet feeding section 11, the corrugated fiberboards S are fed to the printing section 21 one by one at a constant speed. The sheet feeding section 11 includes a table 12, a front stopper 13, supply rollers 14, a suction unit 15, and a feed roll 16. Several corrugated fiberboards S are placed on the table 12 so as to be stacked, and the table 12 is supported so as to be lifted and lowered. The front stopper 13 can position the front end position of each of the corrugated fiberboards S stacked on the table 12, and a gap which allows one corrugated fiberboard S to pass through a portion between a lower end portion of the front stopper 13 and the table 12 is secured. Several supply rollers 14 are disposed corresponding to the table 12 in the transfer direction D of the corrugated fiberboard S. When the table 12 is lowered, the corrugated fiberboard S located at the lowermost position of several stacked corrugated fiberboards S can be fed forward by the supply rollers 14. The stacked corrugated fiberboards S are suctioned downward, that is, toward the table 12 side or the supply roller 14 side by the suction unit 15. The feed roll 16 can supply the corrugated fiberboard S fed by the supply rollers 14 to the printing section 21.

The printing section 21 performs multi-color printing (in the present embodiment, four-color printing) on a surface of the corrugated fiberboard S. In the printing section 21, four printing units 21A, 21B, 21C, and 21D are disposed in series, and printing can be performed on the surface of the corrugated fiberboard S using four ink colors. The printing units 21A, 21B, 21C, and 21D are approximately similarly configured to each other, and each of the printing units 21A, 21B, 21C, and 21D includes a printing cylinder 22, an ink supply roll (anilox roll) 23, an ink chamber 24, and a receiving roll 25. A printing die 26 is mounted on an outer peripheral portion of the printing cylinder 22, and the printing cylinder 22 is rotatably provided. The ink supply roll 23 is disposed so as to contact against the printing die 26 in the vicinity of the printing cylinder 22, and is rotatably provided. The ink chamber 24 stores ink and is provided in the vicinity of the ink supply roll 23. The corrugated fiberboard S is interposed between the receiving roll 25 and the printing cylinder 22, the receiving roll 25 transfers the corrugated fiberboard S while applying a predetermined printing pressure to the corrugated fiberboard S, and the receiving roll 25 is rotatably provided so as to face the lower portion of the printing cylinder 22. In addition, although not shown, a pair of upper and lower feed rolls is provided in front of and behind each of the printing units 21A, 21B, 21C, and 21D.

In the slotter creaser section 31, creasing line processing, cutting, slicing, and gluing margin strip processing are performed on the corrugated fiberboard S by the slotter device. The slotter creaser section 31 includes first creasing line rolls 32, second creasing line rolls 33, first slotter heads 34, second slotter heads 35, and slitter heads 36. The first creasing line rolls 32 and the second creasing line rolls 33 perform the creasing line processing on a rear surface (lower surface) of the corrugated fiberboard S. The first slotter heads 34 and the second slotter heads 35 perform the slicing on the corrugated fiberboard S at a predetermined position and performs the gluing margin strip processing on the corrugated fiberboard S. The slitter heads 36 are provided to be adjacent to the second slotter heads 35 and cut an end portion in a width direction of the corrugated fiberboard S.

In the die cutting section 41, drilling for forming a hand hole or the like is performed on the corrugated fiberboard S. The die cutting section 41 includes a pair of upper and lower feeding pieces 42, an anvil cylinder 43, and a knife cylinder 44. The feeding pieces 42 are rotatably provided such that the corrugated fiberboard S is transferred in a state where the corrugated fiberboard S is interposed between the upper portion and the lower portion. Each of the anvil cylinder 43 and the knife cylinder 44 is circularly formed, and the anvil cylinder 43 and the knife cylinder 44 are rotatable in synchronization with each other by a drive device (not shown). A head and a die are formed at predetermined positions of an outer peripheral portion of the knife cylinder 44 while an anvil is formed on an outer peripheral portion of the anvil cylinder 43.

In the folding section 61, the corrugated fiberboard S is folded while being moved in the transfer direction D, and both end portions in the width direction of the corrugated fiberboard S are joined to each other so as to form a flat corrugated box B. The folding section 61 includes an upper transfer belt 62, lower transfer belts 63 and 64, and a sheet folding device (folder gluer) 65. The upper transfer belt 62 and the lower transfer belts 63 and 64 transfer the corrugated fiberboard S and the corrugated box B in a state where the corrugated fiberboard S and the corrugated box B are interposed between the upper portion and the lower portion. Although the sheet folding device 65 will be described later, the sheet folding device 65 folds each end portion in the width direction of the corrugated fiberboard S while bending the end portion downward. In addition, the folding section 61 includes a gluing device 66. The gluing device 66 includes a glue gun, glue is ejected at a predetermined timing by the glue gun, and gluing can be applied to a predetermined position of the corrugated fiberboard S.

In the counter-ejector section 71, after the corrugated boxes B are stacked while being counted, the corrugated boxes B are sorted by a predetermined number of batches, and thereafter, the sorted corrugated boxes B are discharged. The counter-ejector section 71 includes a hopper device 72. The hopper device 72 includes an elevator 73 on which corrugated boxes B are stacked and which can be lifted and lowered, and a front stopper and an angle arrangement plate are provided in the elevator 73. In addition, an ejection conveyor 74 is provided below the hopper device 72.

Here, in the box making machine 10 of the above-described embodiment, an operation for manufacturing the corrugated box B from the corrugated fiberboard S is described. In the box making machine 10 of the present embodiment, after printing, creasing line processing, processing of grooves and gluing margin strips, and punching are performed on the corrugated fiberboard S, the corrugated fiberboard S is folded so as to manufacture the corrugated box B.

Figure 2:
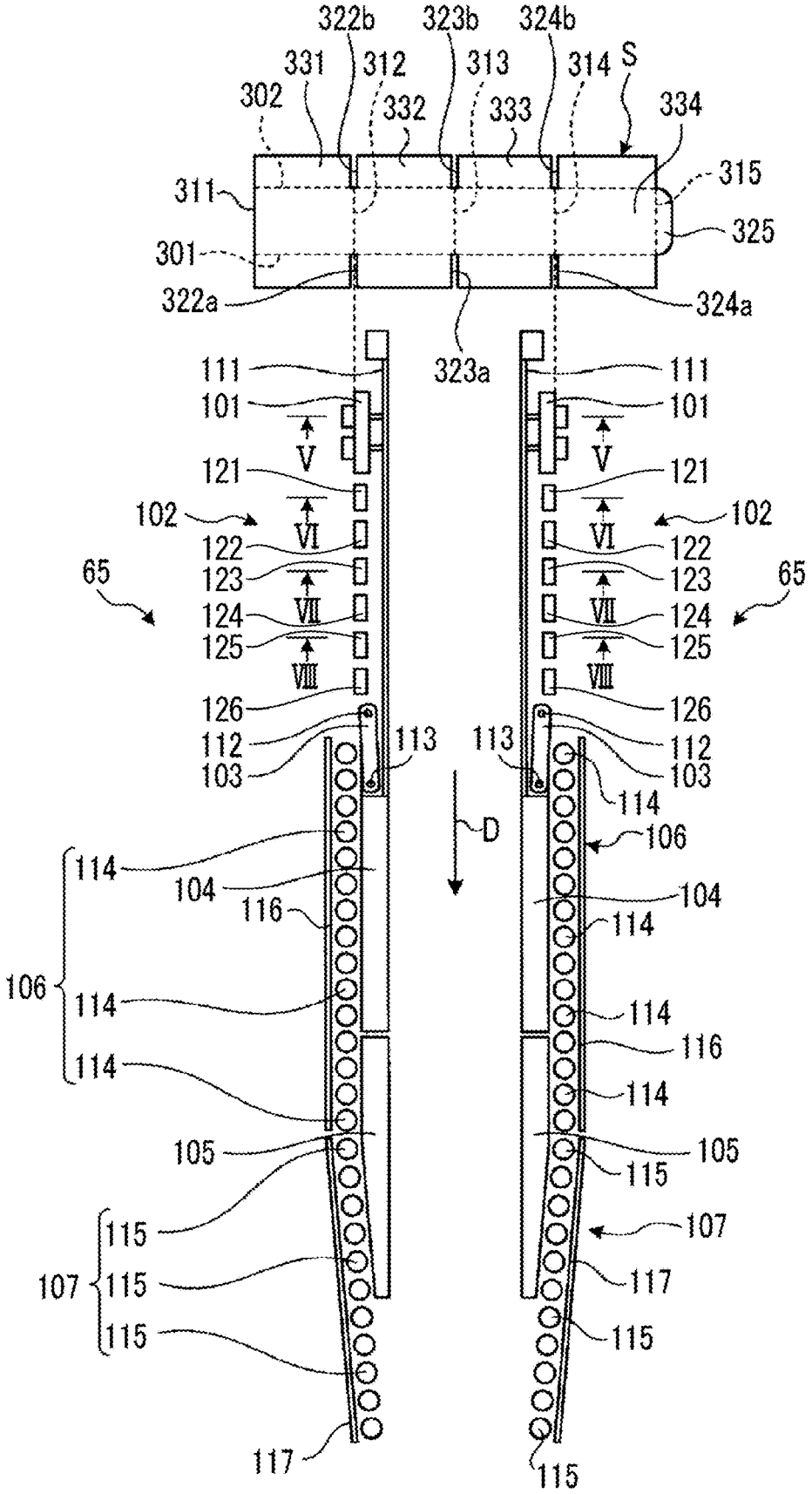
FIG. 2 is a schematic plan view showing a sheet folding device of the present embodiment.

The corrugated fiberboard S is formed by gluing a medium forming a waveform between a bottom liner and a top liner. As shown in FIG. 2, in the corrugated fiberboard S, two folding lines 301 and 302 are formed in a pre-process of the box making machine 10. The folding lines 301 and 302 are used for folding a flap when the corrugated box B manufactured by the box making machine 10 is assembled later. As shown in FIG. 1, the corrugated fiberboards S are stacked on the table 12 of the sheet feeding section 11.

In the sheet feeding section 11, first, the several corrugated fiberboards S stacked on the table 12 are positioned by the front stopper 13, and thereafter, the table 12 is lowered, and the corrugated fiberboard S positioned at the lowermost position is fed by several supply rollers 14. Accordingly, the corrugated fiberboard S is supplied to the printing section 21 at a predetermined constant speed by the pair of feed rolls 16.

In the printing section 21, ink is supplied from the ink chamber 24 to the surface of the ink supply roll 23 in each of the printing units 21A, 21B, 21C, and 21D, and if the printing cylinder 22 and the ink supply roll 23 rotate, the ink on the surface of the ink supply roll 23 is transferred to the printing die 26. If the corrugated fiberboard S is transferred to a portion between the printing cylinder 22 and the receiving roll 25, the corrugated fiberboard S is interposed between the printing die 26 and the receiving roll 25, and a printing pressure is applied to the corrugated fiberboard S so as to perform printing on the surface of the corrugated fiberboard S. The printed corrugated fiberboard S is transferred to the slotter creaser section 31 by the feed rolls.

In the slotter creaser section 31, first, when the corrugated fiberboard S passes through the first creasing line rolls 32, as shown in FIG. 2, creasing lines 312, 313, 314, and 315 are formed on the rear surface (top liner) side of the corrugated fiberboard S. In addition, when the corrugated fiberboard S passes through the second creasing line rolls 33, the creasing lines 312, 313, 314, and 315 are formed on the rear surface (top liner) side of the corrugated fiberboard S again.

Next, when the corrugated fiberboard S in which the creasing lines 312, 313, 314, and 315 are formed passes through the first and second slotter heads 34 and 35, grooves 322*a*, 322*b*, 323*a*, 323*b*, 324*a*, and 324*b* are formed at the positions of the creasing lines 312, 313, and 314. In this case, an end portion is cut at the position of the creasing line 315, and a gluing margin strip 325 is formed. In addition, when the corrugated fiberboard S passes through the slitter heads 36, an end portion is cut at a position of a cutting position 311. Accordingly, the corrugated fiberboard S includes four sheet pieces 331, 332, 333, and 334 which have the creasing lines 312, 313, and 314 (grooves 322*a*, 322*b*, 323*a*, 323*b*, 324*a*, and 324*b*) as boundaries.

In the die cutting section 41, when the corrugated fiberboard S passes through a portion between the anvil cylinder 43 and the knife cylinder 44, a hand hole (not shown) is formed. However, since the hand hole processing is appropriately performed according to the kind of the corrugated fiberboard S, when the hand hole is not required, a blade attachment base (punching blade) for performing the hand hole processing is removed from the knife cylinder 44, and the corrugated fiberboard S passes through the portion between the rotating anvil cylinder 43 and knife cylinder 44. In addition, the corrugated fiberboard S in which the hand hole is formed is transferred to the folding section 61.

In the folding section 61, the glue is applied to the gluing margin strip 325 (refer to FIG. 2) by the gluing device 66 while the corrugated fiberboard S is moved in the transfer direction D by the upper transfer belt 62 and the lower transfer belts 63 and 64, and thereafter, the corrugated fiberboards S is folded downward by the sheet folding device 65 with the creasing lines 312 and 314 (refer to FIG. 2) as base points. If this folding advances to nearly 180°, the folding force becomes stronger, the gluing margin strip 325 and the end portion of the corrugated fiberboard S are pressed to each other so as to come into close contact with each other, both end portions of the corrugated fiberboard S are joined to each other, and the corrugated box B is formed. In addition, the corrugated box B is transferred to the counter-ejector section 71.

In the counter-ejector section 71, the corrugated box B is fed to the hopper device 72, a tip portion of the corrugated box B in the transfer direction D abuts on the front stopper, and the corrugated boxes B are stacked on the elevator 73 in a state of being arranged by the angle arrangement plate. In addition, if a predetermined number of corrugated boxes B are stacked on the elevator 73, the elevator 73 is lowered, a predetermined number of corrugated boxes B become one batch, are discharged by the ejection conveyor 74, and are fed to the post-process of the box making machine 10.

Here, the sheet folding device 65 of the present embodiment will be described in detail. FIG. 2 is a schematic plan view showing the sheet folding device of the present embodiment, FIG. 3 is a schematic side view showing the sheet folding device, and FIG. 4 is a schematic view showing an operation of the sheet folding device.

Figure 3:
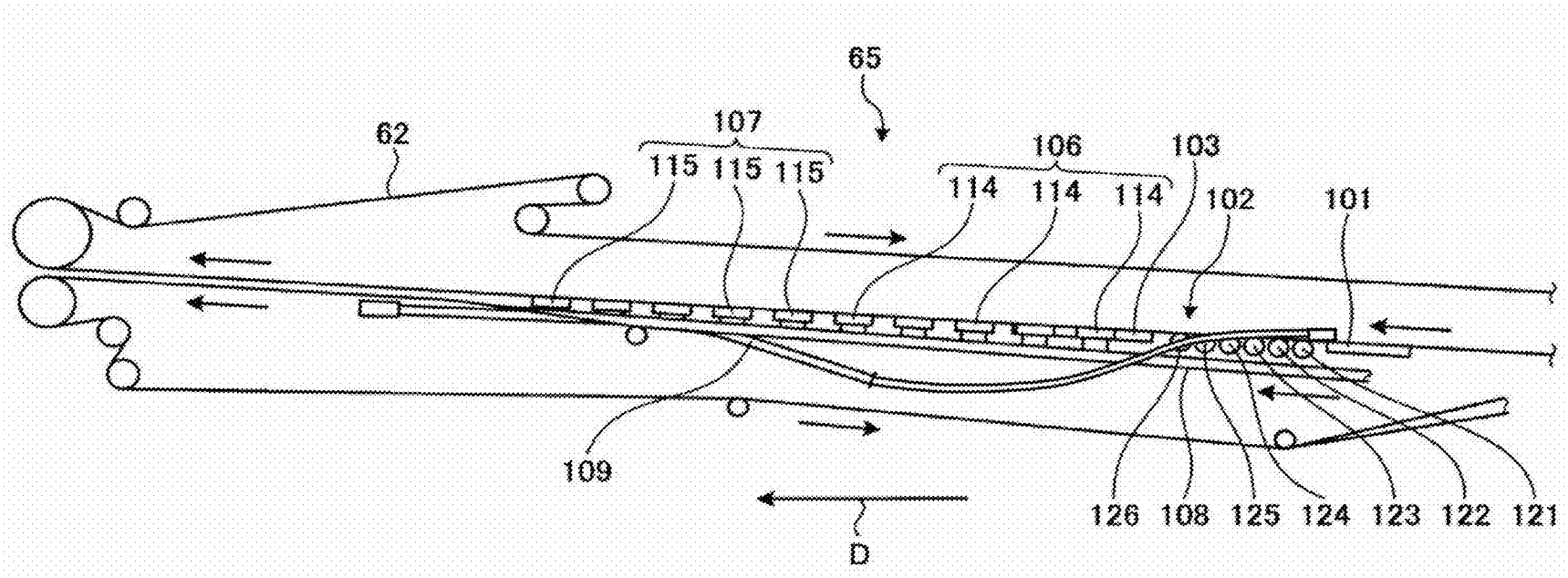
FIG. 3 is a schematic side view showing the sheet folding device.
Figure 4:
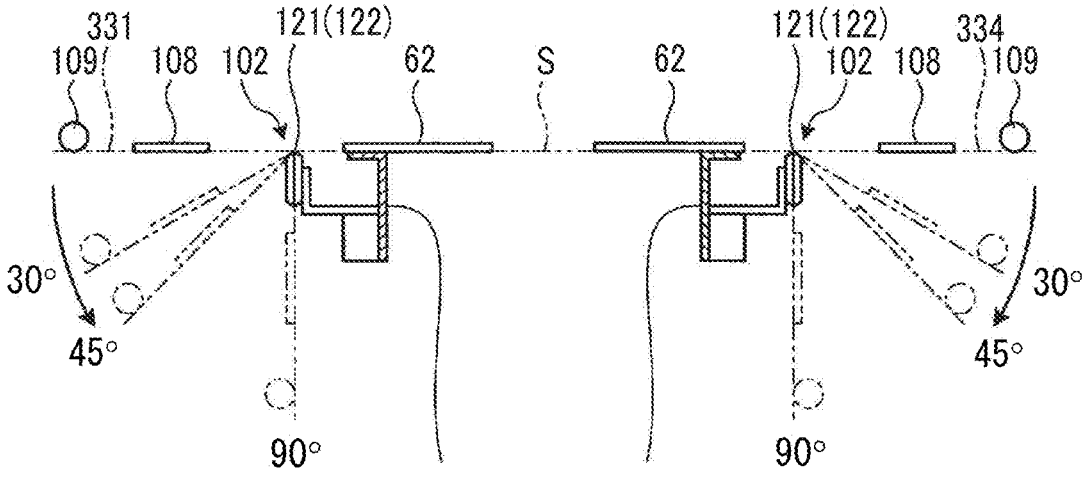
FIG. 4 is a schematic view showing an operation of the sheet folding device.

As shown in FIGS. 2 to 4, the sheet folding device 65 includes first folding rails 101, forming roller groups 102, second folding rails 103, first guide plates 104, second guide plates 105, first gauge roller groups 106, second gauge roller groups 107, forming belts 108, and folding bars 109.

A pair of right and left upper transfer belts 62 is provided on an upper side in a vertical direction, and is provided over the entire length of the sheet folding device 65 in the transfer direction D. Each upper transfer belt 62 is an endless belt and is configured to be wound around several pulleys supported by a pair of right and left upper frames (not shown) so that the upper transfer belt 62 can circulate. In each of the circulating upper transfer belts 62, a lower side thereof moves in the transfer direction D and an upper side thereof moves in a direction opposite to the transfer direction D.

A pair of right and left lower frames 111 facing the pair of right and left upper frames is provided vertically below the pair of right and left upper frames, and the pair of right and left upper transfer belts 62 is disposed to face the pair of right and left lower frames 111 above the pair of right and left lower frames 111. A pair of right and left first folding rails 101 is disposed along the transfer direction D on both sides in the transfer direction D of the corrugated fiberboard S. The respective first folding rails 101 (refer to FIG. 5) are supported outside the pair of right and left lower frames 111 and are disposed to be approximately parallel in the transfer direction D. In the respective first folding rails 101, positions in a width direction in a bending portion along the transfer direction D are disposed at positions in the width direction corresponding to the respective creasing lines 312 and 314 on a lower surface of the corrugated fiberboard S transferred in the transfer direction D. Accordingly, the corrugated fiberboard S is transferred while sheet pieces 331 and 334 on end portion sides in the width direction are folded downward with respect to respective sheet pieces 332 and 333 on a center side in the width direction at positions at which the respective creasing lines 312 and 314 abut against bending portions of the respective first folding rails 101.

The forming roller groups 102 are disposed along the transfer direction D on both sides in the transfer direction D of the corrugated fiberboard S. Each of the forming roller groups 102 includes several forming rollers 121, 122, 123, 124, 125, and 126. The first forming rollers 121, the second forming rollers 123, and the third forming rollers 125 are used for a multi-layer corrugated fiberboard, and the first forming rollers 122, the second forming rollers 124, and the third forming rollers 126 are used for a single-layer corrugated fiberboard. The single-layer corrugated fiberboard is obtained by sticking a top liner to a corrugated medium (core paper) so as to form a single-faced corrugated fiberboard and sticking a bottom liner to the single-faced corrugated fiberboard. The multi-layer corrugated fiberboard is obtained by overlapping several single-faced corrugated fiberboards and thereafter, sticking the bottom liner to the overlapped one-side corrugated fiberboards.

The respective forming rollers 121, 122, 123, 124, 125, and 126 are rotatably supported outside the pair of right and left lower frames 111 and are disposed to be approximately parallel in the transfer direction D. In the respective forming rollers 121, 122, 123, 124, 125, and 126, positions in a width direction in a bending portion along the transfer direction D are disposed at the positions in the width direction corresponding to the respective creasing lines 312 and 314 on the lower surface of the corrugated fiberboard S transferred in the transfer direction D. Accordingly, the corrugated fiberboard S is transferred while sheet pieces 331 and 334 on end portion sides in the width direction are folded downward with respect to the respective sheet pieces 332 and 333 on a center side in the width direction at positions at which the respective creasing lines 312 and 314 abut against bending portions of the respective forming rollers 121, 122, 123, 124, 125, and 126.

A pair of right and left second folding rails 103 are disposed in series along the transfer direction D on both sides in the transfer direction D of the corrugated fiberboard S. The respective second folding rails 103 are supported outside the pair of right and left lower frames 111. The respective second folding rails 103 are disposed to be inclined such that downstream sides of the respective second folding rails 103 in the transfer direction D approach each other, and each inclination angle can be adjusted. In the respective second folding rails 103, positions in a width direction in a bending portion along the transfer direction D are disposed at positions in the width direction corresponding to the respective creasing lines 312 and 314 on the lower surface of the corrugated fiberboard S transferred in the transfer direction D. Accordingly, the corrugated fiberboard S is transferred while the sheet pieces 331 and 334 on the end portion sides in the width direction are folded downward with respect to the respective sheet pieces 332 and 333 on the center side in the width direction at positions at which the respective creasing lines 312 and 314 abut against bending portions of the respective second folding rails 103.

A pair of right and left first guide plates 104 and a pair of right and left second guide plates 105 are disposed in series along the transfer direction D on both sides in the transfer direction D of the corrugated fiberboard S. The respective first guide plates 104 and the respective second guide plates 105 are disposed in series along the transfer direction D on the downstream sides of the respective second folding rails 103 in the transfer direction D. The respective first guide plates 104 are disposed to be approximately parallel in the transfer direction D and the respective second guide plates 105 are disposed to be approximately parallel in the transfer direction D. However, outer surfaces on the downstream sides of the second guide plates 105 in the transfer direction D are formed in inclined surfaces.

In the respective first guide plates 104 and the respective second guide plates 105, positions in a width direction in a bending portion along the transfer direction D are disposed at the positions in the width direction corresponding to the respective creasing lines 312 and 314 on the lower surface of the corrugated fiberboard S transferred in the transfer direction D. Accordingly, the corrugated fiberboard S is transferred while the sheet pieces 331 and 334 on the end portion sides in the width direction are folded downward with respect to the respective sheet pieces 332 and 333 on the center side in the width direction at the positions at which the respective creasing lines 312 and 314 abut against the bending portions of the respective first guide plates 104 and the respective second guide plates 105.

A pair of right and left first gauge roller groups 106 and a pair of right and left second gauge roller groups 107 are disposed in series along the transfer direction D on both sides in the transfer direction D of the corrugated fiberboard S. The respective first gauge roller groups 106 and the respective second gauge roller groups 107 are disposed to face each other outside the respective second folding rails 103, the respective first guide plates 104, and the respective second guide plates 105 in the width direction. The respective first gauge roller groups 106 include several first gauge rollers 114, the respective second gauge roller groups 107 include several second gauge rollers 115, the respective gauge rollers 114 and 115 are rotatably supported by support plates 116 and 117, and the respective support plates 116 and 117 are supported outside the respective lower frames 111. In addition, the respective gauge rollers 114 and 115 can be driven and rotated synchronously by a drive device (not shown).

The respective first gauge roller groups 106 and the respective second gauge roller groups 107 have holding portions (recessed portions) on a circumferential surface thereof along the transfer direction D, and positions of the respective holding portion in the width direction are disposed at positions in the width direction corresponding to the respective creasing lines 312 and 314 on the lower surface of the corrugated fiberboard S transferred in the transfer direction D. In addition, shapes of the holding portions in the respective first gauge roller groups 106 and the respective second gauge roller groups 107 are changed according to the shape of the folding portion of the folded corrugated fiberboard S. Accordingly, after the corrugated fiberboard S is bent downward at the positions of the respective creasing lines 312 and 314, an outer peripheral portion (upper surface side) of the corrugated fiberboard S is held by the holding portions of the respective first gauge roller groups 106 and the respective second gauge roller groups 107, and thus, the corrugated fiberboard S is transferred while the sheet pieces 331 and 334 on the end portion sides in the width direction are folded with respect to the respective sheet pieces 332 and 333 on the center side in the width direction.

A pair of right and left forming belts 108 are provided in the transfer direction D on the downstream side of the lower transfer belt 63 (refer to FIG. 1) in the transfer direction D. Each forming belt 108 is an endless belt and is configured to be wound around several pulleys (not shown) supported by each lower frame 111 so that the forming belt 108 can circulate. In each of the circulating forming belts 108, an upper side thereof moves in the transfer direction D and a lower side thereof moves in a direction opposite to the transfer direction D. The respective forming belts 108 are inclined and disposed so as to be twisted in the transfer direction D such that the respective forming belts 108 come into contact with the outer surfaces (upper surfaces) of the respective sheet pieces 331 and 334 formed by bending both end portions in the width direction of the corrugated fiberboard S downward so as to face the outer surfaces. Accordingly, when the corrugated fiberboard S is transferred so as to be supported by the first folding rails 101, the forming roller groups 102, the second folding rails 103, the respective guide plates 104 and 105, and the respective gauge roller groups 106 and 107, the respective forming belts 108 fold the sheet pieces 331 and 334 on the end portion sides in the width direction while pressing the sheet pieces 331 and 334 downward and inward in order.

A pair of right and left folding bars 109 are provided on the downstream side in the transfer direction D, and a portion of each folding bar 109 is provided to overlap the second guide plate 105, the first gauge roller group 106, the second gauge roller group 107, and the forming belt 108 in the transfer direction D. Similarly to the respective forming belts 108, the respective folding bars 109 are provided so as to face and come into contact with the outer surfaces (the upper surfaces) of the respective sheet pieces 331 and 334 formed by bending both end portions in the width direction of the corrugated fiberboard S downward. Accordingly, when the corrugated fiberboard S is transferred so as to be supported by the respective first folding rails 101, the forming roller groups 102, the second folding rails 103, the respective guide plates 104 and 105, and the respective gauge roller groups 106 and 107, the respective folding bars 109 press the sheet pieces 331 and 334 on the end portion sides in the width direction downward and inward in order, in cooperation with the respective forming belts 108.

Figure 5:
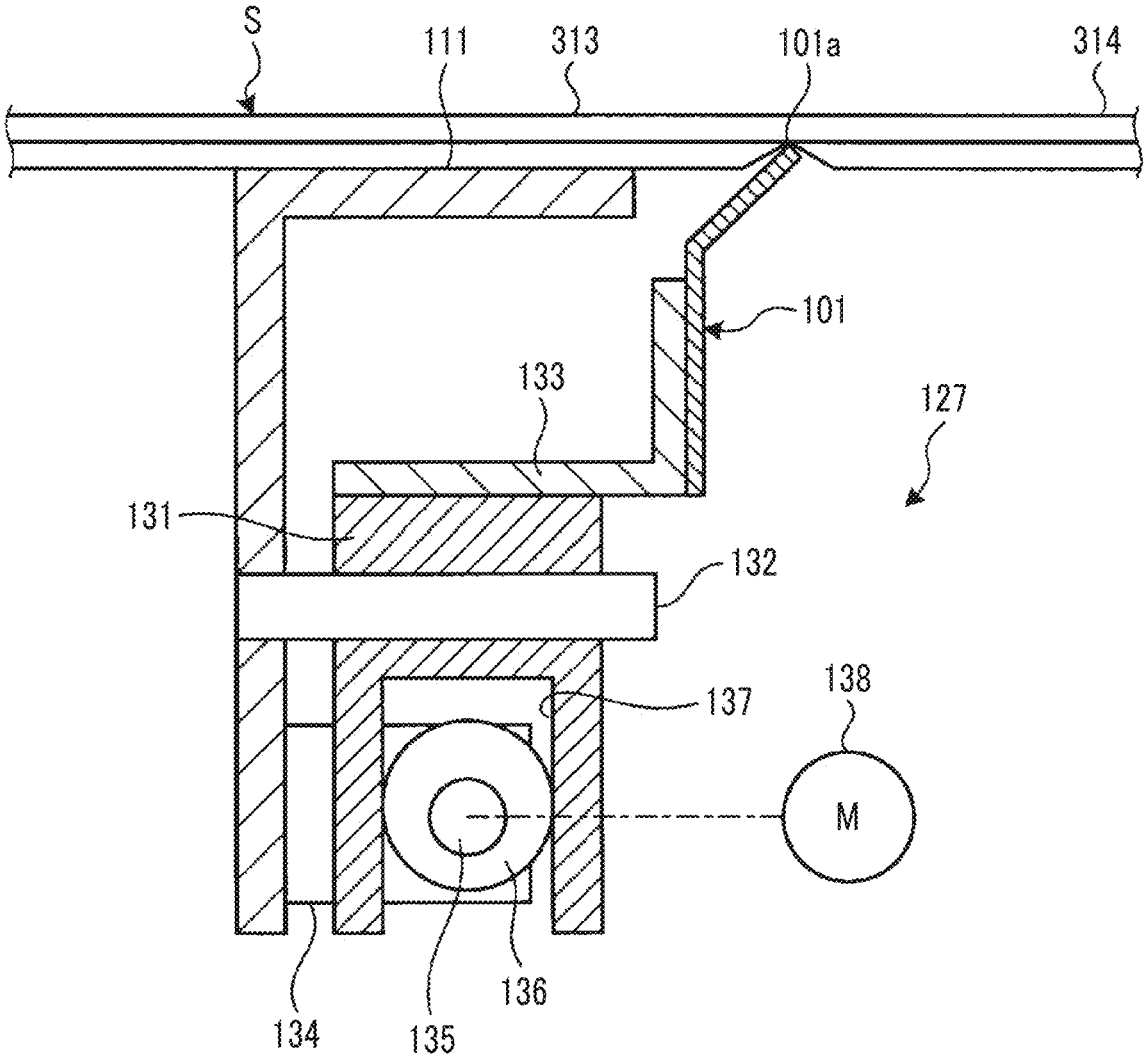
FIG. 5 is a sectional view taken along line V-V of FIG. 2 showing a folding rail.
Figure 6:
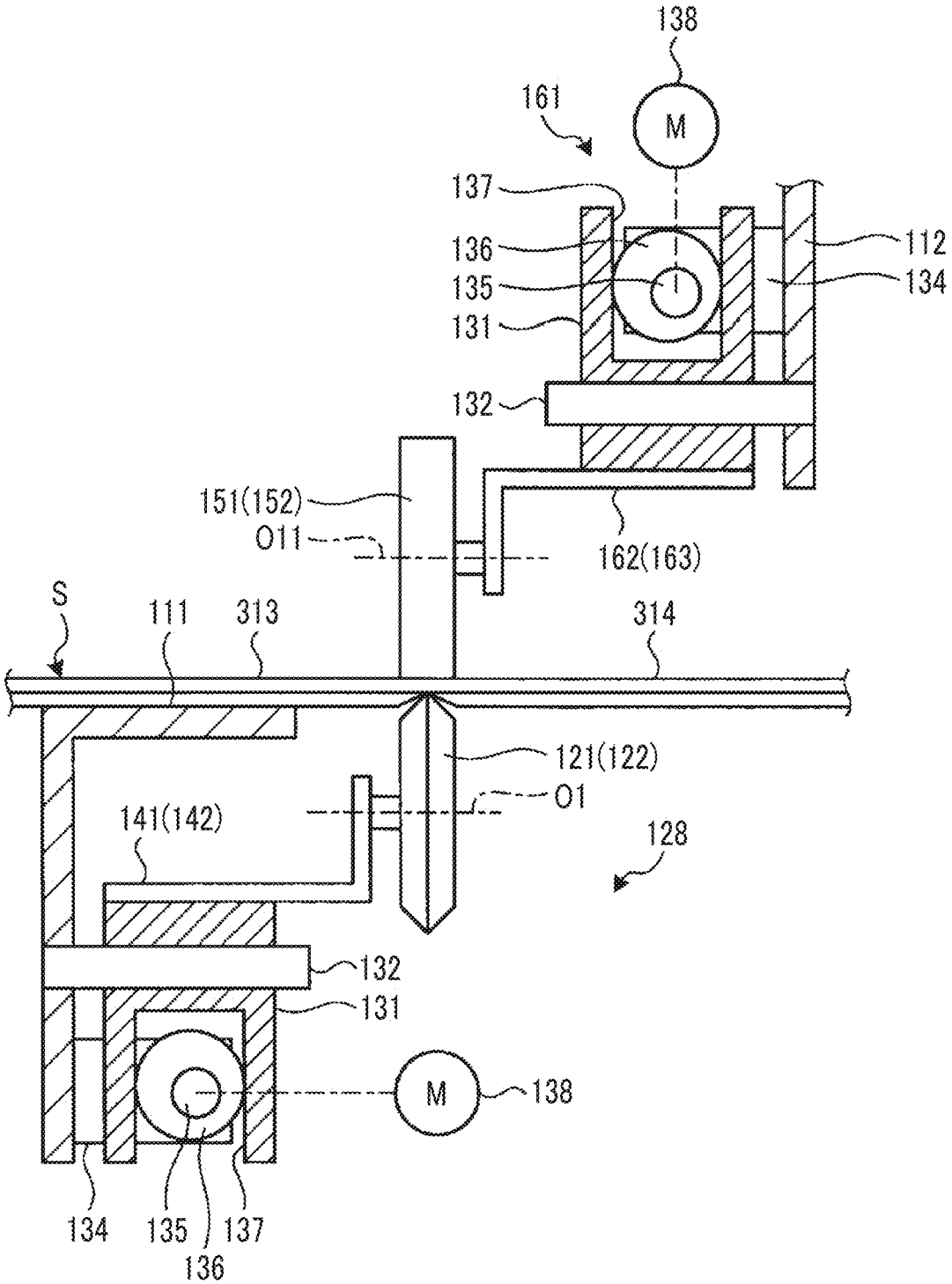
FIG. 6 is a sectional view taken along line VI-VI of FIG. 2 showing a first forming roller.
Figure 7:
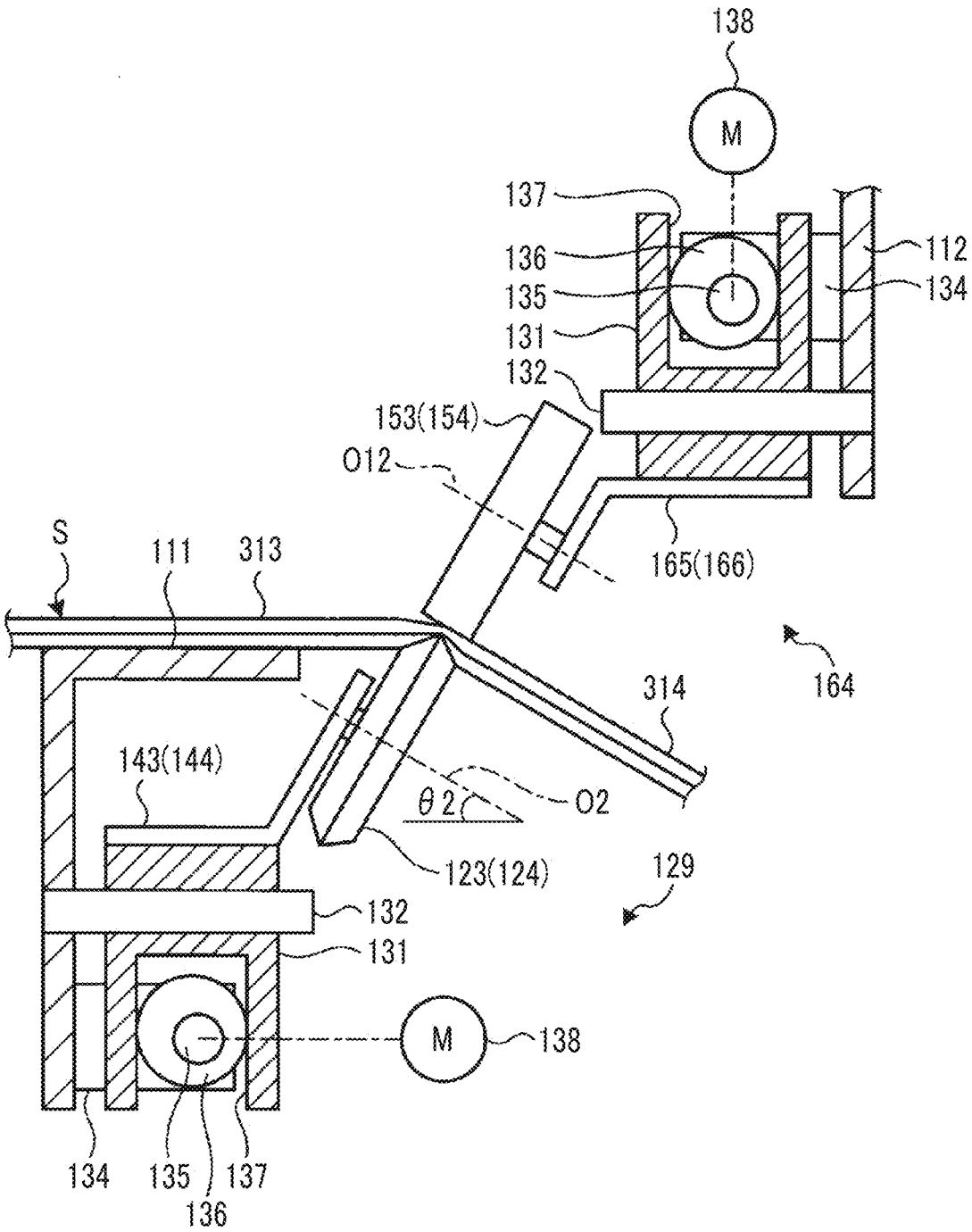
FIG. 7 is a sectional view taken along line VII-VII of FIG. 2 showing a second forming roller.
Figure 8:
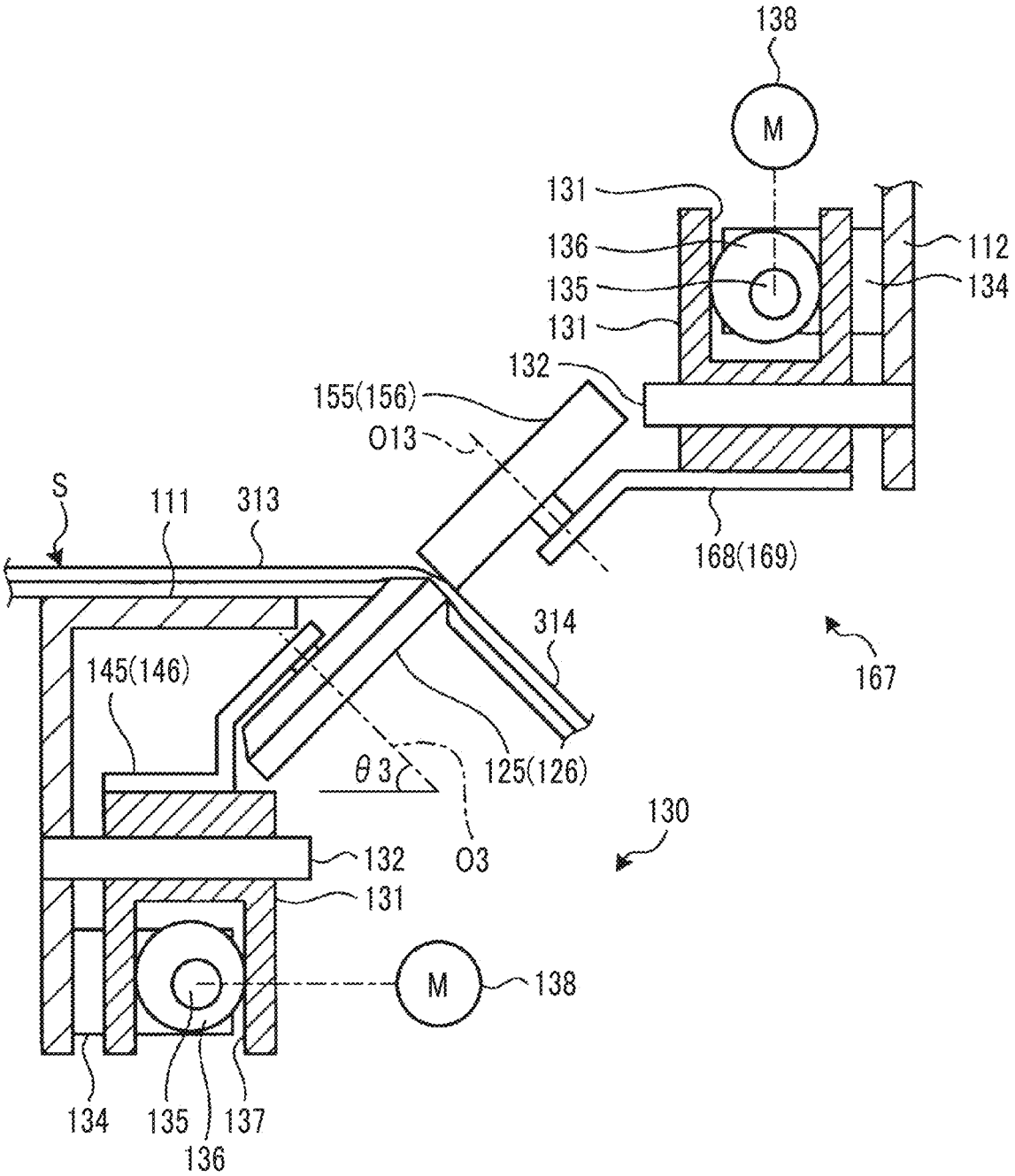
FIG. 8 is a sectional view taken along line VIII-VIII of FIG. 2 showing a third forming roller.

Here, the respective folding rails 101 and 103 and the forming roller groups 102 will be described in detail. FIG. 5 is a sectional view taken along line V-V of FIG. 2 showing each folding rail, FIG. 6 is a sectional view taken along line VI-VI of FIG. 2 showing each first forming roller, FIG. 7 is a sectional view taken along line VII-VII of FIG. 2 showing each second forming roller, and FIG. 8 is a sectional view taken along line VIII-VIII of FIG. 2 showing each third forming roller.

As shown in FIG. 5, in each folding rail 101, the position in the width direction of the corrugated fiberboard S can be adjusted by a folding rail adjustment device 127. In the folding rail adjustment device 127, a supporting shaft 132 extending in the horizontal direction from the lower frame 111 penetrates a support box 131, and the support box 131 is supported to be movable along an axial direction of the supporting shaft 132, that is, the width direction (the horizontal direction orthogonal to the transfer direction D) of the transferred corrugated fiberboard S. The first folding rail 101 is attached to the support box 131 via a bracket 133, and the first folding rail 101 includes a bending portion 101*a* which extends to be inclined outward and upward in the width direction.

A bearing portion 134 extends in the horizontal direction from the lower frame 111, and a tip portion of bearing portion 134 is rotatably supported by a rotating shaft 135. The rotating shaft 135 is disposed along the transfer direction D of the corrugated fiberboard S and an eccentric portion 136 is fixed to a tip portion of the rotating shaft 135. Axis centers of the rotating shaft 135 and the eccentric portion 136 are offset from each other by a predetermined distance. An opening portion 137 is formed in the lower portion of the support box 131, and the eccentric portion 136 is fitted into the opening portion 137. In addition, the rotating shaft 135 can be rotated by a drive device 138.

Accordingly, if the rotating shaft 135 and the eccentric portion 136 are rotated by the drive device 138, the eccentric portion 136 oscillates with respect to the rotating shaft 135, and thus, the support box 131 moves along the axial direction of the supporting shaft 132 by an offset amount of the axis center between the rotating shaft 135 and the eccentric portion 136. If the support box 131 moves along the axial direction of the supporting shaft 132, the first folding rail 101 fixed to the support box 131 moves along the width direction of the corrugated fiberboard S. The folding rail adjustment device 127 specifies a rotation position of the eccentric portion 136 by the drive device 138, and thus, moves the first folding rail 101 in parallel in the width direction of the corrugated fiberboard S and adjusts the position of the first folding rail 101 in the width direction. In addition, the first folding rail 101 moves in the width direction, and thus, the second folding rail 103 moves a connection shaft 112 (refer to FIG. 2) side in the width direction of the corrugated fiberboard S with a connection shaft 113 (refer to FIG. 2) as a supporting point, and can adjust the positions of the second folding rail 103 in the width direction and the horizontal angle of the second folding rail 103.

In the forming roller group 102, as shown in FIG. 6, the first forming roller 121 (122) can adjust the position in the width direction of the corrugated fiberboard S by a first forming roller adjustment device 128. The first forming roller adjustment device 128 has a configuration which is approximately similar to that of the folding rail adjustment device 127. The first forming roller 121 (122) is rotatably supported by a bracket 141 (142), and a rotation axis O1 is set along the width direction (horizontal direction) of the corrugated fiberboard S. In addition, the forming roller group 102 includes a first impression roller 151 (152) facing the first forming roller 121 (122) in a radial direction thereof. The first impression roller 151 (152) can adjust the position in the width direction of the corrugated fiberboard S by a first impression roller adjustment device 161. The first impression roller adjustment device 161 has a configuration which is approximately similar to that of the folding rail adjustment device 127. The first impression roller 151 (152) is rotatably supported by a bracket 162 (163), and a rotation axis O11 is parallel to the rotation axis O1 of the first forming roller 121 (122).

As shown in FIG. 7, the second forming roller 123 (124) can adjust the position in the width direction of the corrugated fiberboard S by a second forming roller adjustment device 129. The second forming roller adjustment device 129 has a configuration which is approximately similar to that of the folding rail adjustment device 127. The second forming roller 123 (124) is rotatably supported by a bracket 143 (144), and a rotation axis O2 is set to be inclined by a predetermined angle θ2 (=30°) with respect to the width direction (horizontal direction) of the corrugated fiberboard S. In addition, the forming roller group 102 includes a second impression roller 153 (154) facing the second forming roller 123 (124) in the radial direction thereof. The second impression roller 153 (154) can adjust the position in the width direction of the corrugated fiberboard S by a second impression roller adjustment device 164. The second impression roller adjustment device 164 has a configuration which is approximately similar to that of the folding rail adjustment device 127. The second impression roller 153 (154) is rotatably supported by a bracket 165 (166) and a rotation axis O12 is set to be parallel to the rotation axis O2 of the second forming roller 123 (124).

As shown in FIG. 8, the third forming roller 125 (126) can adjust the position in the width direction of the corrugated fiberboard S by the third forming roller adjustment device 130. The third forming roller adjustment device 130 has a configuration which is approximately similar to that of the folding rail adjustment device 127. The third forming roller 125 (126) is rotatably supported by a bracket 145 (146), and a rotation axis O3 is set to be inclined by a predetermined angle θ3 (=45°) with respect to the width direction (horizontal direction) of the corrugated fiberboard S. In addition, the forming roller group 102 includes a third impression roller 155 (156) facing the third forming roller 125 (126) in a radial direction thereof. The third impression roller 155 (156) can adjust the position in the width direction of the corrugated fiberboard S by a third impression roller adjustment device 167. The third impression roller adjustment device 167 has a configuration which is approximately similar to that of the folding rail adjustment device 127. The third impression roller 155 (156) is rotatably supported by a bracket 168 (169), and a rotation axis O13 is set to be parallel to the rotation axis O3 of the third forming roller 125 (126).

Figure 9:
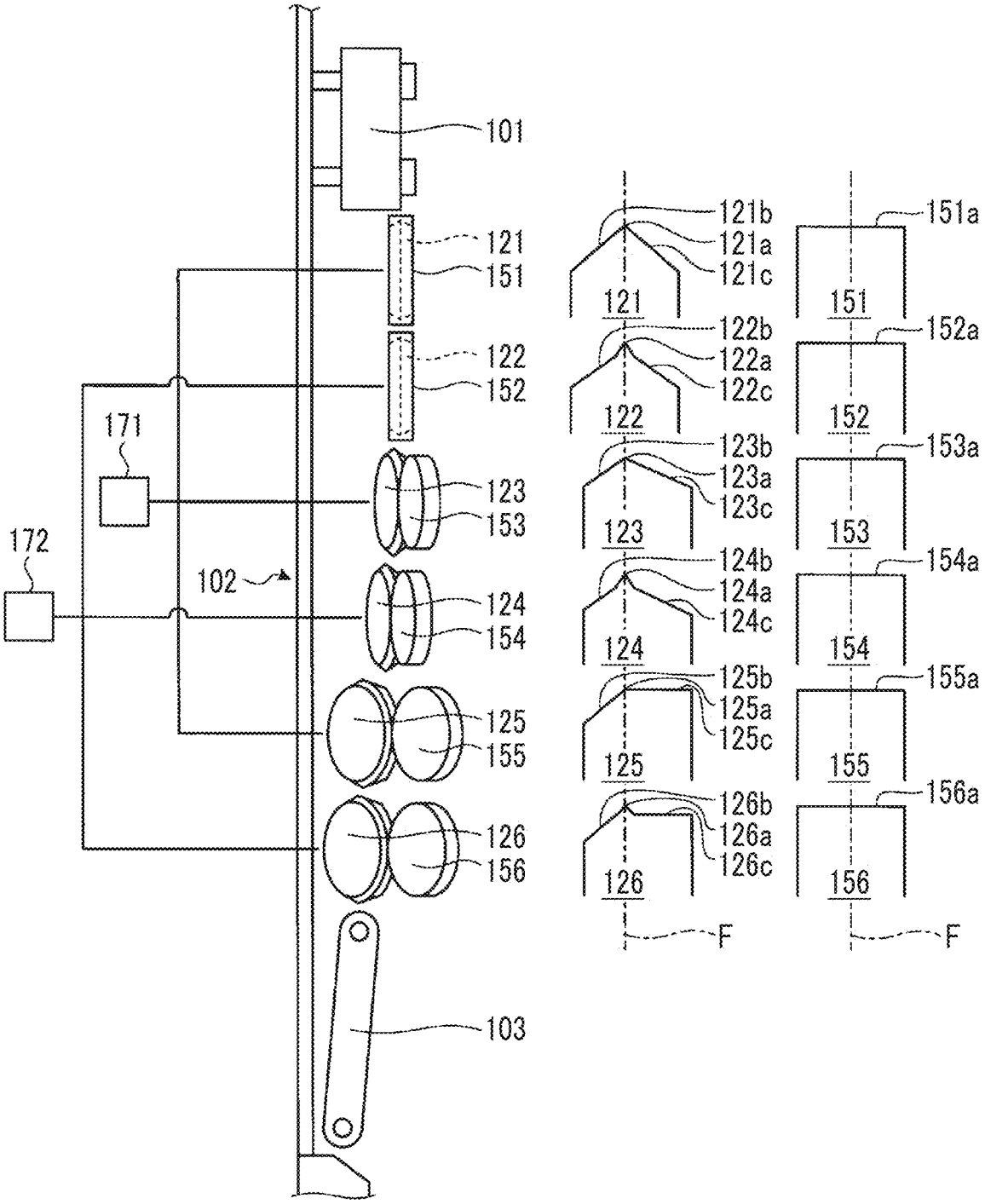
FIG. 9 is a schematic view showing shapes of respective forming rollers.

In addition, the respective forming rollers 121, 122, 123, 124, 125, and 126 and the respective impression rollers 151, 152, 153, 154, 155, and 156 of each forming roller group 102 will be described in detail. FIG. 9 is a schematic view showing shapes of the respective forming rollers.

As shown in FIG. 9, the several forming rollers 121, 122, 123, 124, 125, and 126, and the several impression rollers 151, 152, 153, 154, 155, and 156 are disposed along the transfer direction D of the corrugated fiberboard S and are disposed to be gradually inclined toward the downstream side in the transfer direction D of the corrugated fiberboard S. That is, the rotation axes O1 and O11 of the first forming roller 121 (122) and the first impression roller 151 (152) are along the width direction (horizontal direction) of the corrugated fiberboard S. The rotation axes O2 and O12 of the second forming roller 123 (124) and the second impression roller 153 (154) are inclined by a predetermined angle θ2 (=30°) with respect to the width direction (horizontal direction) of the corrugated fiberboard S. The rotation axes O3 and O13 of the third forming roller 125 (126) and the third impression roller 155 (156) are inclined by a predetermined angle θ3 (=45°) with respect to the width direction (horizontal direction) of the corrugated fiberboard S.

In addition, as shown in FIGS. 6 and 9, the first forming roller 121 is used for the multi-layer corrugated fiberboard and an intermediate portion of the first forming roller 121 in a width direction thereof has a protrusion shape which protrudes outward in a radial direction. That is, the first forming roller 121 includes a protrusion portion 121*a* in which an intermediate portion in the width direction protrudes outward in the radial direction, an inner inclined surface (inner peripheral surface) 121*b* which is provided on the center side in the width direction of the corrugated fiberboard S from the protrusion portion 121*a*, and an outer inclined surface (outer peripheral surface) 121*c* which is provided on the end portion side in the width direction of the corrugated fiberboard S from the protrusion portion 121*a*, and has a symmetrical shape with respect to a folding line (bending position) F in the width direction. In addition, the first forming roller 122 is used for the single-layer corrugated fiberboard and an intermediate portion of the first forming roller 122 in a width direction thereof has a protrusion shape which protrudes outward in the radial direction. That is, the first forming roller 122 includes a protrusion portion 122*a* in which an intermediate portion in the width direction protrudes outward in the radial direction, an inner inclined surface (inner peripheral surface) 122*b* which is provided on the center side in the width direction of the corrugated fiberboard S from the protrusion portion 122*a*, and an outer inclined surface (outer peripheral surface) 122*c* which is provided on the end portion side in the width direction of the corrugated fiberboard S from the protrusion portion 122*a*, and has a symmetrical shape with respect to the folding line F in the width direction. In the first forming roller 121, the protrusion portion 121*a* is smooth with respect to the inclined surfaces 121*b* and 121*c*. However, in the first forming roller 122, the protrusion portion 122*a* protrudes with respect to the inclined surface 122*b* and 122*c*. Meanwhile, in the first impression rollers 151 and 152, outer peripheral surfaces 151*a* and 152*a* are formed to be flat in the radial direction.

As shown in FIGS. 7 and 9, the second forming roller 123 is used for the multi-layer corrugated fiberboard and an intermediate portion of the second forming roller 123 in a width direction thereof has a protrusion shape which protrudes outward in a radial direction. That is, the second forming roller 123 includes a protrusion portion 123*a* in which an intermediate portion in the width direction protrudes outward in the radial direction, an inner inclined surface (inner peripheral surface) 123*b* which is provided on the center side in the width direction of the corrugated fiberboard S from the protrusion portion 123*a*, and an outer inclined surface (outer peripheral surface) 123*c* which is provided on the end portion side in the width direction of the corrugated fiberboard S from the protrusion portion 123*a*, and has an asymmetrical shape with respect to the folding line F in the width direction. That is, the second forming roller 123 is formed such that an angle of the inner inclined surface 123*b* with respect to the direction of the rotation axis O12 is larger than an angle of the outer inclined surface 123*c* with respect to the direction of the rotation axis O12. In addition, the second forming roller 124 is used for the single-layer corrugated fiberboard and an intermediate portion of the second forming roller 124 in a width direction thereof has a protrusion shape which protrudes outward in the radial direction. That is, the second forming roller 124 includes a protrusion portion 124*a* in which an intermediate portion in the width direction protrudes outward in the radial direction, an inner inclined surface (inner peripheral surface) 124*b* which is provided on the center side in the width direction of the corrugated fiberboard S from the protrusion portion 124*a*, and an outer inclined surface (outer peripheral surface) 124*c* which is provided on the end portion side in the width direction of the corrugated fiberboard S from the protrusion portion 124*a*, and has an asymmetrical with respect to the folding line F in the width direction. That is, the second forming roller 124 is formed such that an angle of the inner inclined surface 124*b* with respect to the direction of the rotation axis O12 is larger than an angle of the outer inclined surface 124*c* with respect to the direction of the rotation axis O12. In addition, in the second forming roller 123, the protrusion portion 123*a* is smooth with respect to the inclined surfaces 123*b* and 123*c*. However, in the second forming roller 124, the protrusion portion 124*a* protrudes with respect to the inclined surfaces 124*b* and 124*c*. Meanwhile, in the second impression rollers 153 and 154, outer peripheral surfaces 153*a* and 154*a* are formed to be flat in the radial direction.

In addition, as shown in FIGS. 8 and 9, the third forming roller 125 is used for the multi-layer corrugated fiberboard and an intermediate portion of the third forming roller 125 in a width direction thereof has a protrusion shape which protrudes outward in a radial direction. That is, the third forming roller 125 includes a protrusion portion 125*a* in which an intermediate portion in the width direction protrudes outward in the radial direction, an inner inclined surface (inner peripheral surface) 125*b* which is provided on the center side in the width direction of the corrugated fiberboard S from the protrusion portion 125*a*, and an outer flat surface (outer peripheral surface) 125*c* which is provided on the end portion side in the width direction of the corrugated fiberboard S from the protrusion portion 125*a*, and has an asymmetrical shape with respect to the folding line F in the width direction. That is, the third forming roller 125 is formed such that an angle of the inner inclined surface 125*b* with respect to the direction of the rotation axis O13 is larger than an angle of the outer flat surface 125*c* with respect to the direction of the rotation axis O13. That is, the inner inclined surface 125*b* is inclined with respect to the direction of the rotation axis O13 and the outer flat surface 125*c* is parallel to the direction of the rotation axis O13. In addition, the third forming roller 126 is used for the single-layer corrugated fiberboard and an intermediate portion of the third forming roller 126 in a width direction thereof has a protrusion shape which protrudes outward in the radial direction. That is, the third forming roller 126 includes a protrusion portion 126*a* in which an intermediate portion in the width direction protrudes outward in the radial direction, an inner inclined surface (inner peripheral surface) 126*b* which is provided on the center side in the width direction of the corrugated fiberboard S from the protrusion portion 126*a*, and an outer flat surface (outer peripheral surface) 126*c* which is provided on the end portion side in the width direction of the corrugated fiberboard S from the protrusion portion 126*a*, and has an asymmetrical shape with respect to the folding line F in the width direction. That is, the third forming roller 126 is formed such that an angle of the inner inclined surface 126*b* with respect to the direction of the rotation axis O13 is larger than an angle of the outer flat surface 126*c* with respect to the direction of the rotation axis O13. That is, the inner inclined surface 126*b* is inclined with respect to the direction of the rotation axis O13 and the outer flat surface 126*c* is parallel to the direction of the rotation axis O13. In addition, in the third forming roller 125, the protrusion portion 125*a* is smooth with respect to the inclined surface 125*b* and the flat surface 125*c*. However, in the third forming roller 126, the protrusion portion 126*a* protrudes with respect to the inclined surface 126*b* and the flat surface 126*c*. Meanwhile, in the third impression rollers 155 and 156, outer peripheral surfaces 155*a* and 156*a* are formed to be flat in the radial direction.

In addition, the respective forming rollers 121, 122, 123, 124, 125, and 126 are moved along the vertical direction by respective movement units 171 and 172, and thus, can move close to or away from the corrugated fiberboard S. That is, when the manufactured corrugated fiberboard S is a multi-layer, the respective forming rollers 121, 123, and 125 are moved to a processing position close to the corrugated fiberboard S by the first movement unit 171, and the respective forming rollers 122, 124, and 126 are moved to a retreat position away from the corrugated fiberboard S by the second movement unit 172. Meanwhile, when the manufactured corrugated fiberboard S is a single-layer, the respective forming rollers 121, 123, and 125 are moved to the retreat position away from the corrugated fiberboard S by the first movement unit 171, and the respective forming rollers 122, 124, and 126 are moved to the processing position close to the corrugated fiberboard S by the second movement unit 172.

In addition, in the respective impression rollers 151, 152, 153, 154, 155, and 156, each of the outer peripheral surfaces 151*a*, 152*a*, 153*a*, 154*a*, 155*a*, and 156*a* has the shape which is flat in the radial direction. However, the present invention is not limited to this shape. For example, each outer peripheral surface of the impression rollers 151, 152, 153, 154, 155, and 156 may have a protrusion shape in which an intermediate portion in the width direction protrudes outward in the radial direction, a recessed shape in which the intermediate portion in the width direction is recessed inward in the radial direction, or the like.

In the sheet folding device 65 of the present embodiment, in the above-described forming roller group 102, the respective forming rollers 121, 122, 123, 124, 125, and 126 are disposed on an upstream side in the transfer direction D of the corrugated fiberboard S from a 90° bending position of the corrugated fiberboard S. The forming belts 108 and the folding bars 109 cooperate with each other, and thus, in the corrugated fiberboard S, the sheet pieces 331 and 334 on the end portion sides in the width direction are pressed inward from below in order and are bent 180°. The 90° bending position is a position of the forming belt 108 in the transfer direction of the corrugated fiberboard S when the sheet pieces 331 and 334 of the corrugated fiberboard S are bent 90°. That is, the respective forming rollers 121, 122, 123, 124, 125, and 126 are disposed on an upstream side in the transfer direction D of the corrugated fiberboard S from a position outside the bending position of the forming belt 108 in the width direction of the corrugated fiberboard S.

Hereinafter, a sheet folding method performed by the sheet folding device 65 will be described.

The sheet folding method of the present embodiment includes a step of bending both end portions in the width direction of the corrugated fiberboard S up to before 90° by the forming belts 108 in a state where the bending positions of the transferred corrugated fiberboard S are supported by the forming rollers 121, 122, 123, 124, 125, and 126, and a step of bending both end portions in the width direction of the corrugated fiberboard S up to 180° by the forming belts 108 in a state where the bending positions of the transferred corrugated fiberboard S are supported by the guide plates 104 and 105.

Specifically, as shown in FIG. 2, the corrugated fiberboard S in which the creasing lines 312, 313, and 314 are formed is guided to the upper transfer belt 62 and the lower transfer belt 63 to reach the first folding rails 101, and the respective creasing lines 312 and 314 abut against the bending portions 101*a* of the respective first folding rails 101. First, the corrugated fiberboard S is transferred to the forming rollers 121, 122, 123, 124, 125, and 126 constituting the forming roller groups 102 in a state where the lower surface of the corrugated fiberboard S is supported by the first folding rails 101. In addition, as shown in FIGS. 4 and 6, in the corrugated fiberboard S, the sheet pieces 331 and 334 on the end portion sides in the width direction are pressed downward by the forming belts 108 and the folding bars 109 in a state where lower surface of the corrugated fiberboard at the bending positions (creasing lines 312 and 314) is supported by the first forming rollers 121 (122). Here, in the corrugated fiberboard S, the bending of the sheet pieces 331 and 334 starts at the positions of the first forming rollers 121 (122).

Next, as shown in FIGS. 4 and 7, in the corrugated fiberboard S, the sheet pieces 331 and 334 on the end portion sides in the width direction are further pressed downward by the forming belts 108 and the folding bars 109 in a state where the lower surface of the corrugated fiberboard S at the bending positions is supported by the second forming rollers 123 (124) from the first forming rollers 121 (122). Here, in the corrugated fiberboard S, the sheet pieces 331 and 334 are bent up to approximately 30° at the positions of the second forming rollers 123 (124).

Subsequently, as shown in FIGS. 4 and 8, in the corrugated fiberboard S, sheet pieces 331 and 334 on the end portion sides in the width direction are further pressed downward by the forming belts 108 and the folding bars 109 in a state where the lower surface of the corrugated fiberboard S at the bending positions is supported by the third forming rollers 125 (126) from the second forming rollers 123 (124). Here, in the corrugated fiberboard S, the sheet pieces 331 and 334 are bent up to approximately 45° at the positions of the third forming rollers 125 (126).

In addition, as shown in FIGS. 2 and 4, the corrugated fiberboard S, the sheet pieces 331 and 334 on the end portions in the width direction are pressed toward the center side by forming belts 108 and folding bars 109 in a state where the lower surface of the corrugated fiberboard S at the bending positions is supported by the second folding rails 103 from the third forming rollers 125 (126). Here, in the corrugated fiberboard S, sheet pieces 331 and 334 are bent up to approximately 90° at the positions of the second folding rails 103.

Thereafter, as shown in FIG. 2, in the corrugated fiberboard S, the sheet pieces 331 and 334 on the end portion side in the width direction are pressed upward by the forming belts 108 and the folding bars 109 in a state where the lower surface of the corrugated fiberboard S at the bending positions are supported by the respective guide plates 104 and 105 and an outer surface thereof is supported by the respective gauge roller groups 106 and 107. Here, corrugated fiberboard S is folded up to 180° such the sheet pieces 331 and 334 come into contact with the respective sheet pieces 332 and 333 on the center side in the width direction, and thus, the flat corrugated box B is formed.

When the corrugated fiberboard S is bent at the bending positions (creasing lines 312 and 314) so as to form the sheet pieces 331 and 334, the respective forming rollers 121, 122, 123, 124, 125, and 126 are disposed at the positions at which the sheet pieces 331 and 334 of the corrugated fiberboard S are bent from 0° to 45°, and the first folding rails 101 are disposed at the positions at which the sheet pieces 331 and 334 are bent 45° or more. Accordingly, the respective forming rollers 121, 122, 123, 124, 125, and 126 are not embraced inside the corrugated fiberboard S bent 90° or more, and the corrugated fiberboard S is bent at a desired bending position (creasing lines 312 and 314).

In this way, the sheet folding device of the present embodiment includes the forming belts 108 which move to the center side in the width direction of the corrugated fiberboard S toward the downstream side in the transfer direction D of the corrugated fiberboard S so as to press and bend both end portions of the corrugated fiberboard S in the width direction from outside, and forming roller groups 102 including the forming rollers 121, 122, 123, 124, 125, and 126 which come into contact with the inner sides of both bending portions of the corrugated fiberboard S in the width direction on the center side in the width direction of the corrugated fiberboard S from the forming belts 108, and the forming rollers 121, 122, 123, 124, 125, and 126 are disposed on the upstream side in the transfer direction D of the corrugated fiberboard S from the 90° bending position of the corrugated fiberboard S.

Accordingly, the forming belts 108 move to the center side in the width direction toward the downstream side in the transfer direction D of the corrugated fiberboard S in a state where the forming rollers 121, 122, 123, 124, 125, and 126 support the inner sides of both bending portions of the corrugated fiberboard S in the width direction, and thus, both end portions of the corrugated fiberboard S in the width direction are pressed and bent from the outside. In this case, the forming rollers 121, 122, 123, 124, 125, and 126 support the bending portions of the corrugated fiberboard S on the upstream side in the transfer direction of the corrugated fiberboard S from the 90° bending position of the corrugated fiberboard S, and thus, the forming rollers 121, 122, 123, 124, 125, and 126 are not embraced inside the corrugated fiberboard S bent 90° or more, and offset of the bending position of the corrugated fiberboard S can be suppressed. As a result, the corrugated fiberboard S can be bent at an appropriate position, and it is possible to improve bending accuracy of the corrugated fiberboard S.

In the sheet folding device of the present embodiment, the forming rollers 121, 122, 123, 124, 125, and 126 are disposed on the upstream side in the transfer direction D of the corrugated fiberboard S from the position outside the bending position of the forming belt 108 in the width direction of the corrugated fiberboard S. Accordingly, the forming belts 108 move to the center side in the width direction toward the downstream side in the transfer direction D of the corrugated fiberboard S in a state where the forming rollers 121, 122, 123, 124, 125, and 126 support the inner sides of both bending portions of the corrugated fiberboard S in the width direction, and thus, both end portions of the corrugated fiberboard S are pressed and bent from the outside on a region outside the bending position of the corrugated fiberboard S, the forming rollers 121, 122, 123, 124, 125, and 126 are not embraced inside the corrugated fiberboard S bent 90° or more, and the offset of the bending position of the corrugated fiberboard S can be suppressed.

In the sheet folding device of the present embodiment, the first folding rails 101 are disposed along the transfer direction of the corrugated fiberboard S on the upstream side in the transfer direction D of the corrugated fiberboard S from the forming rollers 121, 122, 123, 124, 125, and 126. Accordingly, after the corrugated fiberboard S is supported by the first folding rails 101, the corrugated fiberboard S is supported by the forming rollers 121, 122, 123, 124, 125, and 126, both end portions thereof are pressed and bent by the forming belts 108, and thus, it is possible to improve the bending accuracy of the corrugated fiberboard S.

In the sheet folding device of the present embodiment, the second folding rails 103 are disposed are disposed along the transfer direction of the corrugated fiberboard S on the downstream side in the transfer direction D of the corrugated fiberboard S from the forming rollers 121, 122, 123, 124, 125, and 126. Accordingly, the corrugated fiberboard S is supported by the forming rollers 121, 122, 123, 124, 125, and 126, both end portions thereof are pressed and bent up to before 90° by the forming belts 108, and thereafter, the corrugated fiberboard S is supported by the second folding rails 103, and thus, it is possible to improve the bending accuracy of the corrugated fiberboard S.

In the sheet folding device of the present embodiment, each of the forming rollers 121, 122, 123, 124, 125, and 126 has the protrusion shape in which the intermediate portion in the width direction protrudes outward in the radial direction, and the impression rollers 151, 152, 153, 154, 155, and 156 which are flat in the radial direction are disposed on the outer peripheral surfaces facing the forming rollers 121, 122, 123, 124, 125, and 126 in the radial direction. Accordingly, when both end portions of the corrugated fiberboard S are pressed and bent from the outside by the forming belts 108, the inner side of the corrugated fiberboard S is supported by the forming rollers 121, 122, 123, 124, 125, and 126 each having the protrusion shape, the outer side of the corrugated fiberboard S is supported by the flat impression rollers 151, 152, 153, 154, 155, and 156, and thus, damages of the corrugated fiberboard S can be suppressed and the corrugated fiberboard S can be bent at an appropriate bending position.

In the sheet folding device of the present embodiment, the several forming rollers 121, 122, 123, 124, 125, and 126 and the several impression rollers 151, 152, 153, 154, 155, and 156 are disposed along the transfer direction D of the corrugated fiberboard S, and are disposed to be gradually inclined toward the downstream side in the transfer direction D of the corrugated fiberboard S. The corrugated fiberboard S can be appropriately bent up to a predetermined angle gradually.

In the sheet folding device of the present embodiment, the forming rollers 121, 122, 123, 124, 125, and 126 include the protrusion portions 121*a*, 122*a*, 123*a*, 124*a*, 125*a*, and 126*a* in which the intermediate portions in the width direction protrude outward in the radial direction, the inner inclined surfaces 121*b*, 122*b*, 123*b*, 124*b*, 125*b*, and 126*b* which are provided on the center side in the width direction of the corrugated fiberboard S, and the outer inclined surfaces 121*c*, 122*c*, 123*c*, 124*c*, 125*c*, and 126*c* which are provided on the end portion side in the width direction of the corrugated fiberboard S, and the angles of the inner inclined surfaces 121*b*, 122*b*, 123*b*, 124*b*, 125*b*, and 126*b* with respect to the axial direction are larger than the angles of the outer inclined surfaces 121*c*, 122*c*, 123*c*, 124*c*, 125*c*, and 126*c* with respect to the axial direction. Accordingly, when the end portion of the corrugated fiberboard S is bent, excessive contacts between the sheet pieces 332 and 333 whose horizontal states are maintained and the inner inclined surfaces 121*b*, 122*b*, 123*b*, 124*b*, 125*b*, and 126*b* are prevented, and it is possible to prevent deformation or damages of the corrugated fiberboard S.

The sheet folding device of the present embodiment includes the forming rollers 122, 124, and 126 for the single-layer corrugated fiberboard in which a waveform portion is a single layer and the forming rollers 121, 123, and 125 for the multi-layer corrugated fiberboard in which the waveform portion is a multi layer, and the forming rollers can be moved to the processing position and the retreat position by the movement units 171 and 172. Therefore, according to a type of the corrugated fiberboard, the forming rollers 122, 124, and 126 for the single-layer corrugated fiberboard and the forming rollers 121, 123, and 125 for the multi-layer corrugated fiberboard are selectively moved to processing positions by the movement units 171 and 172 and are used, and thus, the corrugated fiberboard S is bent by the forming rollers 121, 122, 123, 124, 125, and 126 corresponding to the type of the corrugated fiberboard, the damages of the corrugated fiberboard S are suppressed, and the corrugated fiberboard S can be bent at an appropriate bending position.

In addition, the sheet folding method of the present embodiment includes the step of bending both end portions in the width direction of the corrugated fiberboard S up to before 90° by the forming belts 108 in the state where the bending positions of the transferred corrugated fiberboard S are supported by the forming rollers 121, 122, 123, 124, 125, and 126, and the step of bending both end portions in the width direction of the corrugated fiberboard S up to 180° by the forming belts 108 in the state where the bending positions of the transferred corrugated fiberboard S are supported by the guide plates 104 and 105. Accordingly, the forming rollers 121, 122, 123, 124, 125, and 126 are not embraced inside the corrugated fiberboard S bent 90° or more, and the offset of the bending position of the corrugated fiberboard S can be suppressed. As a result, the corrugated fiberboard S can be bent at an appropriate position, and it is possible to improve bending accuracy of the corrugated fiberboard S.

In addition, in the box making machine of the present embodiment includes the sheet feeding section 11, the printing section 21, the slotter creaser section 31, the die cutting section 41, the folding section 61, and the counter-ejector section 71, and the sheet folding device 65 is provided in the folding section 61. Accordingly, the printing is performed on the corrugated fiberboard S from the sheet feeding section 11 in the printing section 21, the creasing line processing and the slicing are performed in the slotter creaser section 31, the corrugated fiberboard S is folded in the folding section 61 such that the end portions are joined to each other so as to form the corrugated box B, and the corrugated boxes B are stacked while being counted in the counter-ejector section 71. In this case, in the sheet folding device 65, the forming rollers 121, 122, 123, 124, 125, and 126 are not embraced inside the corrugated fiberboard S bent 90° or more, and the offset of the bending position of the corrugated fiberboard S can be suppressed. As a result, the corrugated fiberboard S can be bent at an appropriate position, and it is possible to improve bending accuracy of the corrugated fiberboard S.

In addition, in the above-described embodiment, the forming rollers 121, 122, 123, 124, 125, and 126 are disposed at the positions at which the sheet pieces 331 and 334 of the corrugated fiberboard S are bent from 0° to 45°. However, the present invention is not limited to this configuration. For example, the forming rollers may be disposed at the positions at which the sheet pieces 331 and 334 of the corrugated fiberboard S are bent from 10° to 80°. That is, the forming rollers may be supported by the first folding rails at an initial period of the bending of the corrugated fiberboard S, or the forming rollers may be disposed at the position at which the corrugated fiberboard S is bent up to before 90°. The forming rollers may be disposed at the positions at which upstream sides of at least the sheet pieces 331 and 334 of the corrugated fiberboard S are bent from 0° to 5° or at the positions at which downstream sides thereof are bent up to 85°.

In addition, the above-described embodiment, six forming rollers 121, 122, 123, 124, 125, and 126 are provided, and these are used for the multi-layer corrugated fiberboard or the single-layer corrugated fiberboard. However, the number of the forming rollers are not limited to six. That is, the number of the forming rollers may be four or less or eight or more, and the forming roller may be used for only one of the multi-layer corrugated fiberboard and the single-layer corrugated fiberboard. That is, three types of forming rollers 121 (122), 123 (124), and 125 (126) are provided. However, two types or less of forming rollers or four types or more of forming rollers may be used, and the same type of several forming rollers may be used.

In addition, in the above-described embodiment, the folding rail adjustment device 127 or the respective forming roller adjustment devices 128, 129, and 130 are eccentric devices. However, the present invention is not limited to this configuration, and for example, a screw type device or a cylinder type device may be used.

In addition, in the above-described embodiment, the box making machine 10 includes the sheet feeding section 11, the printing section 21, the slotter creaser section 31, the die cutting section 41, the folding section 61, and the counter-ejector section 71. However, the present invention is not limited to this configuration. For example, in a case where the corrugated fiberboard S does not require a hand hole, the die cutting section 41 may be omitted. In addition, the box making machine 10 may include only the sheet feeding section 11, the printing section 21, and the slotter creaser section 31.

REFERENCE SIGNS LIST

11: sheet feeding section
21: printing section
31: slotter creaser section
41: die cutting section
61: folding section
65: sheet folding device
71: counter-ejector section
101: first folding rail (upstream-side folding rail)
102: forming roller group
103: second folding rail (downstream-side folding rail)
104: first guide plate
105: second guide plate
106: first gauge roller group
107: second gauge roller group
108: forming belt
109: folding bar
121, 122: first forming roller
123, 124: second forming roller
125, 126: third forming roller
127: folding rail adjustment device
128: first forming roller adjustment device
129: second forming roller adjustment device
130: third forming roller adjustment device
151, 152: first impression roller
153, 154: second impression roller
155, 156: third impression roller
161: first impression roller adjustment device
164: second impression roller adjustment device
167: third impression roller adjustment device
171: first movement unit
172: second movement unit
331, 334: sheet piece (folding portion)
332, 333: sheet piece (main body portion)
D: transfer direction
S: corrugated fiberboard
B: corrugated box

The invention claimed is:

1. A sheet folding device comprising:

forming belts which are disposed on both sides in a transfer direction of a corrugated fiberboard and move to a center side in a width direction of the corrugated fiberboard toward a downstream side in the transfer direction of the corrugated fiberboard so as to press and bend both end portions of the corrugated fiberboard in the width direction from outside; and forming rollers which are disposed on the center side in the width direction of the corrugated fiberboard from the forming belts on both sides in the transfer direction of the corrugated fiberboard and come into contact with inner sides of both bending portions of the corrugated fiberboard in the width direction, wherein the forming rollers are disposed on an upstream side in the transfer direction of the corrugated fiberboard from a 90° bending position of the corrugated fiberboard, and wherein the forming roller includes a protrusion portion in which an intermediate portion in a thickness direction of the forming roller protrudes outward in a radial direction of the forming roller, an inner peripheral surface on a center side in the width direction of the corrugated fiberboard from the protrusion portion, and an outer peripheral surface on an end side in the width direction of the corrugated fiberboard from the protrusion portion, and wherein the forming rollers include rollers having an asymmetrical contact surface contacting the corrugated fiberboard, with respect to a plane which is perpendicular to a rotation axis direction of the forming roller and intersects an outermost portion of the protrusion portion in the radial direction.

2. The sheet folding device according to claim 1, wherein in a state that the forming rollers support the bending portions, the forming belts press the corrugated fiberboard at an area outside the bending portions in the width direction of the corrugated fiberboard.

3. The sheet folding device according to claim 1, wherein upstream-side folding rails are disposed on both sides in the transfer direction of the corrugated fiberboard along the transfer direction of the corrugated fiberboard on the upstream side in the transfer direction of the corrugated fiberboard from the forming rollers.

4. The sheet folding device according to claim 1, wherein downstream-side folding rails are disposed on both sides in the transfer direction of the corrugated fiberboard along the transfer direction of the corrugated fiberboard on the downstream side in the transfer direction of the corrugated fiberboard from the forming rollers.

5. The sheet folding device according to claim 1, wherein the forming rollers have a protrusion shape in which the intermediate portion in the thickness direction of the forming roller protrudes outward in the radial direction of the forming roller, and impression rollers respectively facing the forming rollers in the radial direction and each having an outer peripheral surface which is flat in the radial direction are disposed.

6. The sheet folding device according to claim 5, wherein several forming rollers and several impression rollers are disposed along the transfer direction of the corrugated fiberboard and are disposed to be gradually inclined toward the downstream side in the transfer direction of the corrugated fiberboard.

7. The sheet folding device according to claim 1, wherein the forming rollers include a forming roller for a single-layer corrugated fiberboard in which a waveform portion is a single layer and a forming roller for a multi-layer corrugated fiberboard in which a waveform portion is a multi layer, and a movement unit which moves the forming roller for the single-layer corrugated fiberboard and the forming roller for the multi-layer corrugated fiberboard to a processing position and a retreat position is provided.

8. A box making machine comprising:

a sheet feeding section which supplies a corrugated fiberboard;

a printing section which performs printing on the corrugated fiberboard;

a slotter creaser section which performs creasing line processing and slicing on the printed corrugated fiberboard;

a folding section which includes the sheet folding device according to claim 1; and a counter-ejector section which stacks flat corrugated boxes while counting the flat corrugated boxes and thereafter, discharges the flat corrugated boxes every predetermined number.

9. The sheet folding device according to claim 1, wherein shapes of the forming rollers change as the forming rollers are located more toward the downstream side of the sheet folding device.

10. The sheet folding device according to claim 1, wherein an angle of the inner peripheral surface with respect to the rotation axis direction of the forming roller is larger than an angle of the outer peripheral surface with respect to the rotation axis direction, and the angle of the outer peripheral surface decreases as the forming rollers are located more toward the downstream side of the sheet folding device.

11. A sheet folding method comprising:

a step of bending both end portions in a width direction of the corrugated fiberboard up to before 90° by a forming belt in a state where a bending position of a transferred corrugated fiberboard is supported by forming rollers; and a step of bending the both end portions in the width direction of the corrugated fiberboard up to 180° by the forming belt in a state where the bending position of the transferred corrugated fiberboard is supported by a guide plate, wherein the forming roller includes a protrusion portion in which an intermediate portion in a thickness direction of the forming roller protrudes outward in a radial direction of the forming roller, an inner peripheral surface on a center side in the width direction of the corrugated fiberboard from the protrusion portion, and an outer peripheral surface on an end side in the width direction of the corrugated fiberboard from the protrusion portion, and wherein the forming rollers include rollers having an asymmetrical contact surface, with respect to a plane which is perpendicular to a rotation axis direction of the forming roller and intersects an outermost portion of the protrusion portion in the radial direction.

* * * * *